US008968040B2

(12) United States Patent
Ito

(10) Patent No.: US 8,968,040 B2
(45) Date of Patent: Mar. 3, 2015

(54) METHOD OF OPERATING A MARINE VESSEL PROPULSION SYSTEM, MARINE VESSEL PROPULSION SYSTEM, AND MARINE VESSEL INCLUDING THE SAME

(71) Applicant: Yamaha Hatsudoki Kabushiki Kaisha, Iwata-shi, Shizuoka (JP)

(72) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 37 days.

(21) Appl. No.: 14/048,262

(22) Filed: Oct. 8, 2013

(65) Prior Publication Data

US 2014/0106631 A1 Apr. 17, 2014

(30) Foreign Application Priority Data

Oct. 16, 2012 (JP) ..... 2012-228656

(51) Int. Cl.
*B63H 21/21* (2006.01)
*B63H 20/12* (2006.01)
*B63H 25/42* (2006.01)

(52) U.S. Cl.
CPC ..... *B63H 21/21* (2013.01); *B63H 20/12* (2013.01); *B63H 25/42* (2013.01)
USPC ..... 440/1; 440/53

(58) Field of Classification Search
CPC ..... D63H 21/21; B63H 20/12
USPC ..... 440/1, 53; 701/21
See application file for complete search history.

(56) References Cited

U.S. PATENT DOCUMENTS

| | | | | |
|---|---|---|---|---|
| 6,941,195 | B2 * | 9/2005 | Hamamatsu et al. | 701/21 |
| 7,438,013 | B2 * | 10/2008 | Mizutani | 114/144 RE |
| 7,527,537 | B2 * | 5/2009 | Mizutani | 440/53 |
| 8,272,906 | B2 * | 9/2012 | Ito | 440/1 |
| 8,452,468 | B2 * | 5/2013 | Sakaguchi et al. | 701/21 |
| 2006/0110990 | A1 * | 5/2006 | Yazaki et al. | 440/53 |
| 2007/0049139 | A1 * | 3/2007 | Mizutani | 440/59 |
| 2007/0066157 | A1 * | 3/2007 | Yamashita et al. | 440/63 |
| 2007/0068438 | A1 * | 3/2007 | Mizutani | 114/144 R |
| 2008/0125925 | A1 * | 5/2008 | Mizutani | 701/21 |
| 2010/0151750 | A1 * | 6/2010 | Ito | 440/1 |
| 2014/0106631 | A1 * | 4/2014 | Ito | 440/1 |
| 2014/0106632 | A1 * | 4/2014 | Nakayasu | 440/1 |

* cited by examiner

*Primary Examiner* — Lars A Olson
*Assistant Examiner* — Jovon Hayes
(74) *Attorney, Agent, or Firm* — Keating & Bennett, LLP

(57) ABSTRACT

A marine vessel includes a plurality of turning mechanisms provided respectively in correspondence to a plurality of outboard motors. Each turning mechanism includes a hydraulic pump, an electric motor to drive the hydraulic pump, a hydraulic cylinder including two cylinder chambers partitioned by a piston, and a normally-closed bypass valve to put the two cylinder chambers of the hydraulic cylinder into communication with each other. Upon judging that there is a malfunction in the turning angle control of at least one of the outboard motors, a main ECU displays on a display an operation guidance screen to urge a marine vessel operator to open the bypass valve of the turning mechanism corresponding to the malfunctioning outboard motor. Also, the main ECU keeps a power transmission between an engine and a propeller in the malfunctioning outboard motor in an interrupted state.

17 Claims, 11 Drawing Sheets

2
3S
3C
3P
7S
7P
F
N
R

METHOD OF OPERATING A MARINE VESSEL PROPULSION SYSTEM, MARINE VESSEL PROPULSION SYSTEM, AND MARINE VESSEL INCLUDING THE SAME

BACKGROUND OF THE INVENTION

1. Field of the Invention

The present invention relates to a method of operating a marine vessel propulsion system that includes an outboard motor. The present invention also relates to a marine vessel propulsion system with an outboard motor and a marine vessel including the same.

2. Description of the Related Art

An outboard motor is an example of a propulsion device for a marine vessel and includes a motor and a propeller driven by the motor. The outboard motor is attached to a stern of the marine vessel in a state enabling turning in right and left directions. The marine vessel is equipped with a steering apparatus to control a turning angle of the outboard motor. The steering apparatus turns the outboard motor in accordance with the operation of a steering handle by a marine vessel operator. In a case of a multiple installation arrangement in which a plurality of outboard motors are installed at the stern, the steering apparatus turns the plurality of outboard motors in synchronization.

U.S. 2010/0151750 A1 discloses an arrangement where a steering angle of a steering handle is detected by a steering angle sensor and a plurality of outboard motors are turned in accordance with the detection result. With the arrangement of U.S. 2010/0151750 A1, when there is a malfunction in the turning angle control of any of the outboard motors, the turning angle control of the corresponding outboard motor is stopped. A turning angle range of another normally functioning outboard motor is then restricted in accordance with the turning angle of the outboard motor with the turning angle control malfunction. The turning angle control of the normally functioning outboard motor is performed within the restricted turning angle range. Turning performance of the marine vessel can thus be secured while avoiding interference of the normally functioning outboard motor with the outboard motor with the turning angle control malfunction.

However, with the arrangement of U.S. 2010/0151750 A1, the control is complicated because the other normally functioning outboard motor must be restricted in its turning angle range in accordance with the turning angle of the outboard motor with the turning angle control malfunction. Also, depending on the turning angle of the outboard motor with the turning angle control malfunction, the turning angle range becomes extremely narrow in the other normally functioning outboard motor and a steerable angle range may become significantly restricted thereafter.

SUMMARY OF THE INVENTION

Preferred embodiments of the present invention provide a method of operating a marine vessel propulsion system, a marine vessel propulsion system, and a marine vessel including the same by which a turning performance of a marine vessel is secured by simple control when there is a malfunction in the turning angle control of at least one of a plurality of outboard motors.

In order to overcome the previously unrecognized and unsolved challenges described above, a first preferred embodiment of the present invention provides a method of operating a marine vessel propulsion system that includes a plurality of outboard motors, each including a motor and a propeller rotated by the motor, and a steering apparatus arranged to control turning angles of the plurality of the outboard motors and where the steering apparatus includes a steering member and a plurality of turning mechanisms arranged to turn each of the plurality of outboard motors individually in accordance with an operation of the steering member and each of the turning mechanisms includes a hydraulic cylinder including two cylinder chambers partitioned by a piston and a normally-closed bypass valve to put the two cylinder chambers of the hydraulic cylinder in communication with each other, the method of operating the marine vessel propulsion system including a step of judging whether or not there is a malfunction in a turning angle control of at least one of the outboard motors, a step where, when it is judged that there is the malfunction in the turning angle control of the at least one of the outboard motors, the bypass valve of the turning mechanism, corresponding to the at least one of the outboard motors judged to have the malfunction in the turning angle control, is put in an open state, and a power control step of keeping power transmission, between the motor and the propeller of the at least one of the outboard motors judged to have the malfunction in the turning angle control, in an interrupted state and meanwhile allowing power transmission between the motor and the propeller in the other outboard motor or motors while maintaining the open state of the bypass valve. "Motor" refers inclusively to an internal combustion engine, electric motor, or whatever type of engine that generates a vessel propulsion force.

With the method of the present preferred embodiment, when there is the malfunction in the turning angle control of the at least one of the outboard motors, the bypass valve of the turning mechanism, corresponding to the at least one of the outboard motors with the turning angle control malfunction (hereinafter referred to as the "malfunctioning outboard motor"), is put in the open state. The malfunctioning outboard motor is thus put in a state where, although the turning angle control thereof cannot be performed, it can be turned freely in the right and left directions. Also, the power transmission between the motor and the propeller of the malfunctioning outboard motor is kept in the interrupted state. Generation of a propulsive force by the malfunctioning outboard motor is thus stopped.

On the other hand, the power transmission between the motor and the propeller is allowed in the other outboard motor or motors (a normally functioning outboard motor without a turning angle control malfunction). A propulsive force can thus be generated by the normally functioning outboard motor. Also, the turning angle control of the normally functioning outboard motor is performed as is done normally and thus the turning performance of the marine vessel is secured by the turning angle control of the normally functioning outboard motor. Thus, even when there is a malfunction in the turning angle control of the at least one of the outboard motors, the marine vessel operator can steer the marine vessel by operating the steering member.

Also, with the method of the present preferred embodiment, unlike the prior art described in U.S. 2010/0151750 A1, a control to restrict the turning angle range of the normally functioning outboard motor in accordance with the turning angle of the malfunctioning outboard motor is not necessary. Control is thus easy in comparison to the arrangement and method described in U.S. 2010/0151750 A1. Also, with the present method, the turning angle range of the normally functioning outboard motor is not restricted in accordance with the turning angle of the malfunctioning outboard motor and thus, regardless of a turning angle at which the malfunction occurs, the normally functioning outboard motor can be turned in the same turning angle range as that before the malfunction so that adequate turning performance of the marine vessel is secured.

As mentioned above, the malfunctioning outboard motor is put in a state where the generation of a propulsive force is stopped but turning in the right and left directions is performed freely. Thus, when turning of the normally functioning outboard motor is performed while the marine vessel is moored, the malfunctioning outboard motor is turned by being pushed by the normally functioning outboard motor. Also, when the marine vessel is made to run by the propulsive force of the normally functioning outboard motor, the malfunctioning outboard motor is turned in the same direction as the other normally functioning outboard motor in accordance with a water stream that forms at a periphery of the malfunctioning outboard motor. A possibility of the normally functioning outboard motor contacting the malfunctioning outboard motor during the turning angle control of the normally functioning outboard motor is thus low, and even when contact of the malfunctioning outboard motor with the normally functioning outboard motor occurs, a load due to the contact is small.

The method of operating a marine vessel propulsion system may further include a step where, when it is judged that there is a malfunction in the turning angle control of at least one of the outboard motors, a marine vessel operator is urged to open the bypass valve of the turning mechanism corresponding to the at least one of the outboard motors judged to have the malfunction in the turning angle control.

With this method, when there is the malfunction in the turning angle control of the at least one of the outboard motors, the bypass valve of the turning mechanism corresponding to the malfunctioning outboard motor can be opened reliably by the marine vessel operator.

The method of operating a marine vessel propulsion system may further include a step of judging whether there is the malfunction in the turning angle control of all of the outboard motors or a there is the malfunction in the turning angle control of the at least one of the outboard motors, and a step where, when it is judged that there is the malfunction in the turning angle control of the at least one of the outboard motors, a marine vessel operator is urged to open the bypass valve of the turning mechanism corresponding to the at least one of the outboard motors judged to have a malfunction in the turning angle control.

With this method, when there is the malfunction in the turning angle control of the at least one of the outboard motors, the bypass valve of the turning mechanism corresponding to the malfunctioning outboard motor can be opened reliably by the marine vessel operator.

The method of operating a marine vessel propulsion system may further include a step where, when it is judged that there is the malfunction in the turning angle control of all of the outboard motors, the marine vessel operator is notified that there is the malfunction in the turning angle control of all of the outboard motors.

With this method, when there is the malfunction in the turning angle control of all of the outboard motors, the marine vessel operator is made aware of this.

The method of operating a marine vessel propulsion system may further include a step where, when it is judged that there is the malfunction in the turning angle control of all of the outboard motors, all of the outboard motors are moved to respective turning angle midpoints thereof and not less than one of the plurality of outboard motors is made to generate a propulsive force in the state where all of the outboard motors are fixed at the respective turning angle midpoints.

With this method, when there is the malfunction in the turning angle control of all of the outboard motors, the marine vessel can be made to turn by making use of an output difference among the plurality of outboard motors in the state where all of the outboard motors are fixed at the respective turning angle midpoints. Thus, even when there is the malfunction in the turning angle control of all of the outboard motors, the turning performance of the marine vessel is secured.

The method of operating a marine vessel propulsion system may further include a step where, when it is judged that there is the malfunction in the turning angle control of all of the outboard motors, the bypass valves of the turning mechanisms corresponding to all of the outboard motors are opened, all of the outboard motors are moved to the respective turning angle midpoints, and the bypass valves of the turning mechanisms corresponding to all of the outboard motors are thereafter closed.

With this method, even if all of the outboard motors are not positioned at the respective turning angle midpoints when there is the malfunction in the turning angle control of all of the outboard motors, all of the outboard motors can be moved to and fixed at the respective turning angle midpoints.

The method of operating a marine vessel propulsion system may further include a step where, when it is judged that there is the malfunction in the turning angle control of all of the outboard motors, a rotational speed of the motor is restricted to no more than a predetermined value in all of the outboard motors.

When there is the malfunction in the turning angle control of all of the outboard motors, the marine vessel can be turned by making use of the propulsive force of the outboard motors without performing turning angle control of the outboard motors. However, in this case, if the propulsive force of the outboard motors is too great, it may be difficult to obtain a turning behavior that is intended by the marine vessel operator. Thus, with the method of the present preferred embodiment, the rotational speed of the motor is restricted to no more than the predetermined value in all of the outboard motors when there is the malfunction in the turning angle control of all of the outboard motors. The propulsive force of the outboard motors are thus prevented from becoming too large and marine vessel maneuvering is made easy.

The power control step may include a step of restricting the rotational speed of the motor in the other outboard motor or motors to no more than a predetermined value.

If there is the malfunction in the turning angle control of the at least one of the outboard motors, the turning angle control of another normally functioning outboard motor is performed, wherein the normally functioning outboard motor may contact the malfunctioning outboard motor. Thus, with the method of the present preferred embodiment, when there is the malfunction in the turning angle control of the at least one of the outboard motors, the rotational speed of the motor is restricted to no more than the predetermined value in the other normally functioning outboard motor or motors. A load due to the contact of the normally functioning outboard motor with the malfunctioning outboard motor is thus significantly reduced or prevented.

The method of operating a marine vessel propulsion system may further include a step where, when it is judged that there is the malfunction in the turning angle control of the at least one of the outboard motors, the marine vessel is made to run at a vessel speed lower than a vessel speed corresponding to a maximum propulsive force that can be generated by all of the outboard motors.

With this method, when there is the malfunction in the turning angle control of the at least one of the outboard motors, the marine vessel runs at the vessel speed lower than the vessel speed corresponding to the maximum propulsive force that can be generated by all of the outboard motors and thus even when a normally functioning outboard motor contacts the malfunctioning outboard motor, the load due to the contact is significantly reduced.

A second preferred embodiment of the present invention provides a marine vessel propulsion system including a plurality of outboard motors, each including a motor and a propeller rotated by the motor, and a steering apparatus arranged to control turning angles of the plurality of the outboard motors and where the steering apparatus includes a steering member and a plurality of turning mechanisms to turn each of the plurality of outboard motors individually in accordance with an operation of the steering member, and each of the turning mechanisms includes a hydraulic cylinder including two cylinder chambers partitioned by a piston and a normally-closed bypass valve to put the two cylinder chambers of the hydraulic cylinder in communication with each other, the marine vessel propulsion system further including a malfunction judging unit arranged to judge whether or not there is the malfunction in the turning angle control of at least one of the outboard motors, a notifying unit that, when the malfunction judging unit judges that there is the malfunction in the turning angle control of the at least one of the outboard motors, urges the marine vessel operator to open the bypass valve of the turning mechanism corresponding to the at least one of the outboard motors judged to have the malfunction in the turning angle control, and a power control unit arranged to keep power transmission, between the motor and the propeller of the at least one of the outboard motors judged to have the malfunction in the turning angle control, in an interrupted state and meanwhile allowing power transmission between the motor and the propeller in the other outboard motor or motors.

With the present arrangement, when there is the malfunction in the turning angle control of the at least one of the outboard motors, the marine vessel operator is urged to open the bypass valve of the turning mechanism corresponding to the at least one of the outboard motors with the turning angle control malfunction (hereinafter referred to as the "malfunctioning outboard motor"). When the marine vessel operator opens the bypass valve of the turning mechanism corresponding to the malfunctioning outboard motor, the malfunctioning outboard motor is put in a state where, although the turning angle control thereof cannot be performed, it can be turned freely in the right and left directions. Also, the power transmission between the motor and the propeller of the malfunctioning outboard motor is kept in the interrupted state. Generation of a propulsive force by the malfunctioning outboard motor is thus stopped.

On the other hand, the power transmission between the motor and the propeller is allowed in the other outboard motor or motors (a normally functioning outboard motor without a turning angle control malfunction). A propulsive force can thus be generated by the normally functioning outboard motor. Also, the turning angle control of the normally functioning outboard motor is performed as is done normally and thus the turning performance of the marine vessel is secured by the turning angle control of the normally functioning outboard motor. Thus, even when there is a malfunction in the turning angle control of the at least one of the outboard motors, the marine vessel operator can steer the marine vessel by operating the steering member.

Also, with this arrangement, unlike the prior art described in U.S. 2010/0151750 A1, a control to restrict the turning angle range of the normally functioning outboard motor in accordance with the turning angle of the at least one of the outboard motors with the turning angle control malfunction is not necessary. Control is thus easy in comparison to the arrangement described in U.S. 2010/0151750 A1.

Also, the malfunctioning outboard motor is put in a state where the generation of a propulsive force is stopped but turning in the right and left directions can be performed freely. Thus, when the marine vessel is made to run by the propulsive force of the normally functioning outboard motor, the malfunctioning outboard motor is turned in the same direction as the other normally functioning outboard motor in accordance with a water stream at a periphery of the marine vessel. A possibility of the normally functioning outboard motor contacting the malfunctioning outboard motor during the turning angle control of the normally functioning outboard motor is thus low. Also, even when the normally functioning outboard motor contacts the malfunctioning outboard motor, a load due to the contact is small.

The marine vessel propulsion system may further include a restricting unit that, when the malfunction judging unit judges that there is the malfunction in the turning angle control of the at least one of the outboard motors, restricts a rotational speed of the motor to no more than a predetermined value in the at least one of the outboard motors judged to have a malfunction in the turning angle control.

As mentioned above, when there is the malfunction in the turning angle control of the at least one of the outboard motors, the power transmission between the motor and the propeller of the malfunctioning outboard motor is kept in the interrupted state and thus a rotational force of the motor of the malfunctioning outboard motor is not transmitted to the propeller. Thus, by restricting the rotational speed of the malfunctioning outboard motor to no more than the predetermined value, wasteful consumption of energy is significantly reduced or prevented.

Each of the bypass valves may be a manually opened/closed bypass valve.

Each of the bypass valves may be an automatically opened/closed type bypass valve.

The marine vessel propulsion system may further include a turning angle control stopping unit that, when the malfunction judging unit judges that there is the malfunction in the turning angle control of all of the outboard motors, stops the turning angle control of all of the outboard motors. With this arrangement, the turning angle control of all of the outboard motors can be stopped when there is a malfunction in the turning angle control of all of the outboard motors.

The malfunction judging unit may be arranged to judge that there is the malfunction in the turning angle control of all of the outboard motors when a malfunction due to an input system in common to all of the turning mechanisms is detected and to judge that there is the malfunction in the turning angle control of the at least one of the outboard motors when a malfunction due to output systems of the respective turning mechanisms is detected.

With this arrangement, when a malfunction due to the input system in common to all of the turning mechanisms is detected, it is judged that there is the malfunction in the turning angle control of all of the outboard motors. On the other hand, when the malfunction due to the output systems of the respective turning mechanisms is detected, it is judged that there is the malfunction in the turning angle control of the at least one of the outboard motors.

The malfunction due to the input system may include a malfunction of an operation amount detection sensor arranged to detect an operation amount of the steering member. Also, the malfunction due to the output systems includes a malfunction of turning angle sensors arranged to detect the turning angles of the outboard motors and a malfunction of the respective turning mechanisms.

A third preferred embodiment of the present invention provides a marine vessel including a hull and a marine vessel propulsion system attached to the hull.

With this arrangement, when there is the malfunction in the turning angle control of the at least one of the outboard motors, the marine vessel operator can open the bypass valve of the turning mechanism corresponding to the malfunctioning outboard motor. Also, the power transmission between the motor and the propeller of the malfunctioning outboard motor is kept in the interrupted state. On the other hand, the power transmission between the motor and the propeller in the other normally functioning outboard motor or motors is allowed. Also, the turning angle control of the normally functioning outboard motor is performed as is done normally and thus the turning performance of the marine vessel is secured by the turning angle control of the normally functioning outboard motor. Thus, even when there is the malfunction in the turning angle control of the at least one of the outboard motors, the marine vessel operator can steer the marine vessel by operating the steering member.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
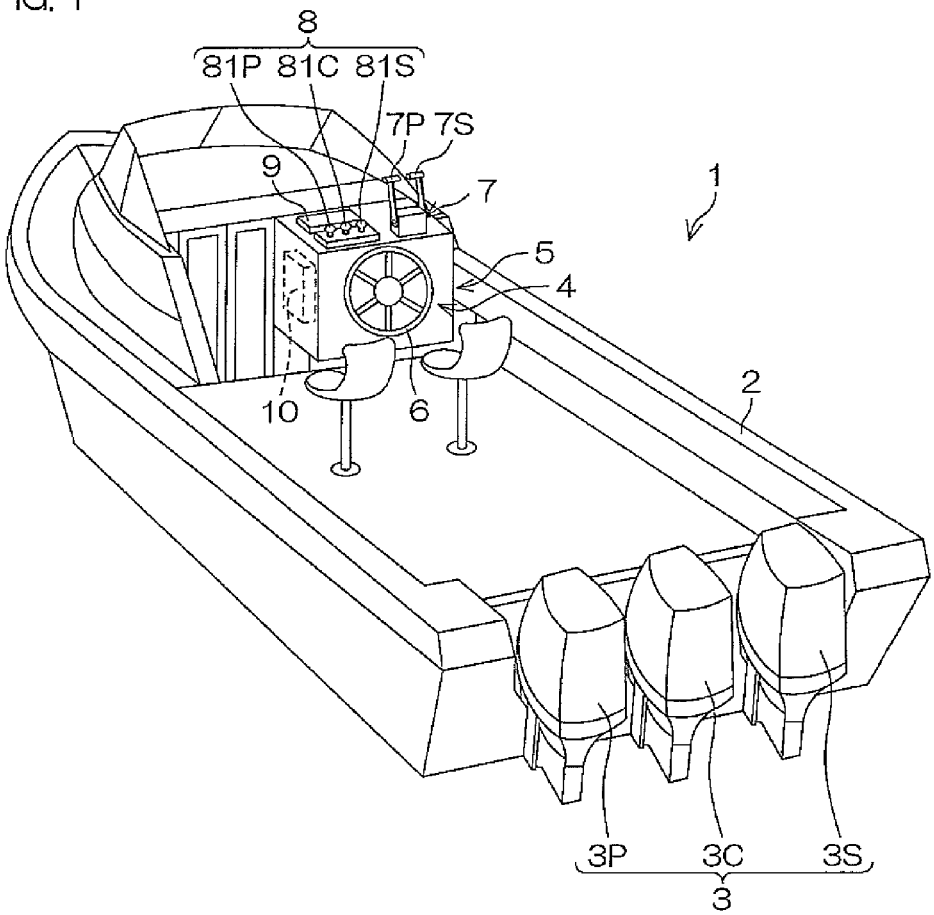
FIG. 1 is a perspective view for describing an arrangement of a marine vessel according to a preferred embodiment of the present invention.

FIG. 1 is a perspective view for describing an arrangement of a marine vessel according to a preferred embodiment of the present invention. The marine vessel 1 includes a hull 2, a plurality of outboard motors 3 as marine vessel propulsion devices, and a steering apparatus 4 that controls turning angles of the respective outboard motors 3. Three outboard motors 3 are provided in the present preferred embodiment. The outboard motors 3 are aligned and attached along a stern of the hull 2 and are put in states enabling swinging (turning) in the right and left directions. When the three outboard motors are to be distinguished, the outboard motor disposed at a starboard side shall be referred to as the "starboard outboard motor 3S," the outboard motor disposed at a center shall be referred to as the "central outboard motor 3C," and the outboard motor disposed at a port side shall be referred to as the "port outboard motor 3P." Each of the outboard motors 3 includes an engine (internal combustion engine as an example of a motor) and a propeller (screw) and generates a propulsive force by rotation of the propeller by a driving force of the engine.

A marine vessel operator compartment 5 is provided at a front portion (stem portion) of the hull 2. The marine vessel operator compartment 5 includes a steering handle 6 as a steering member, a remote controller 7, an operation panel 8, a display 9, and a main ECU (electronic control unit) 10.

Figure 3:
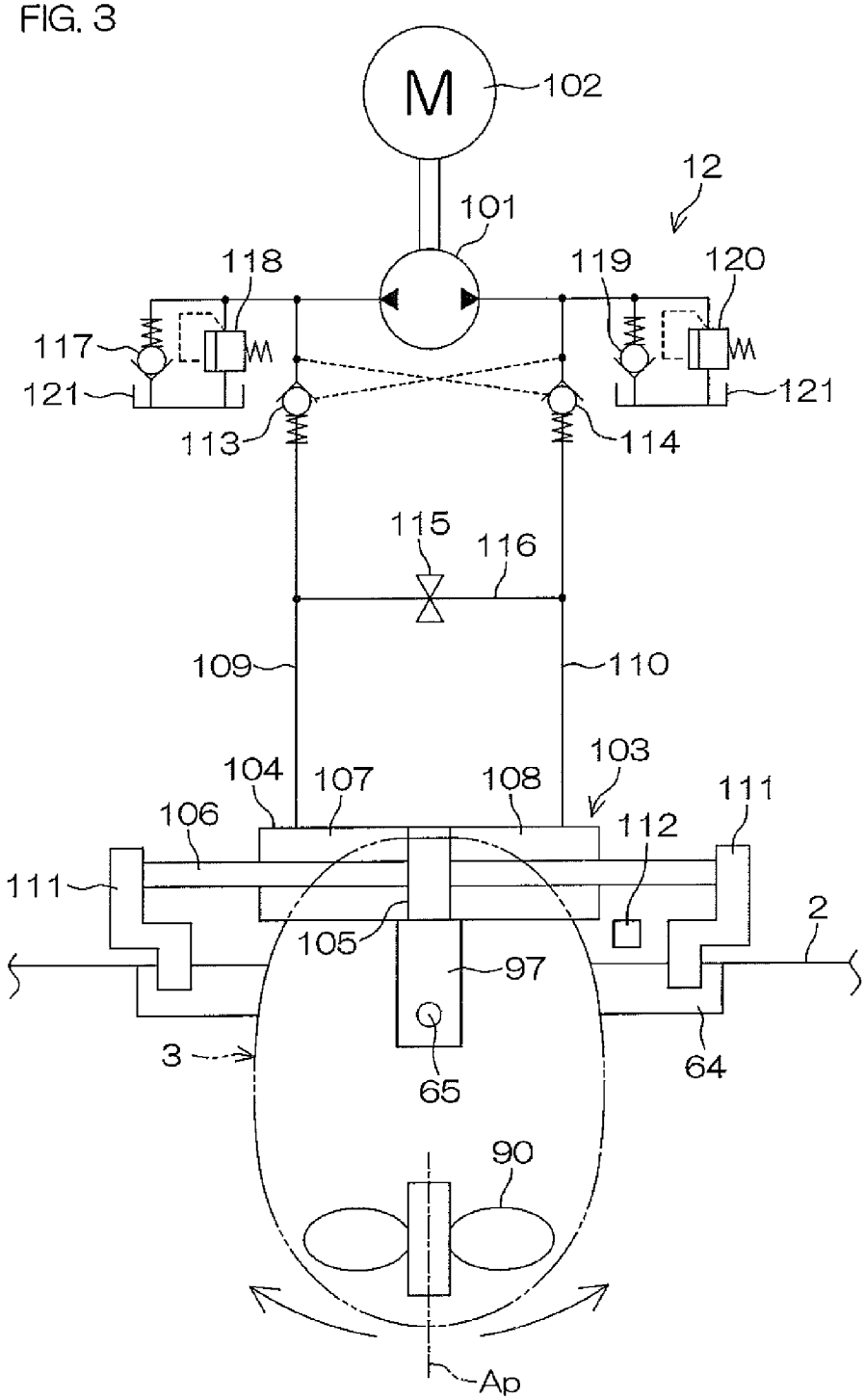
FIG. 3 is an arrangement diagram for describing an arrangement of a turning mechanism.
Figure 4:
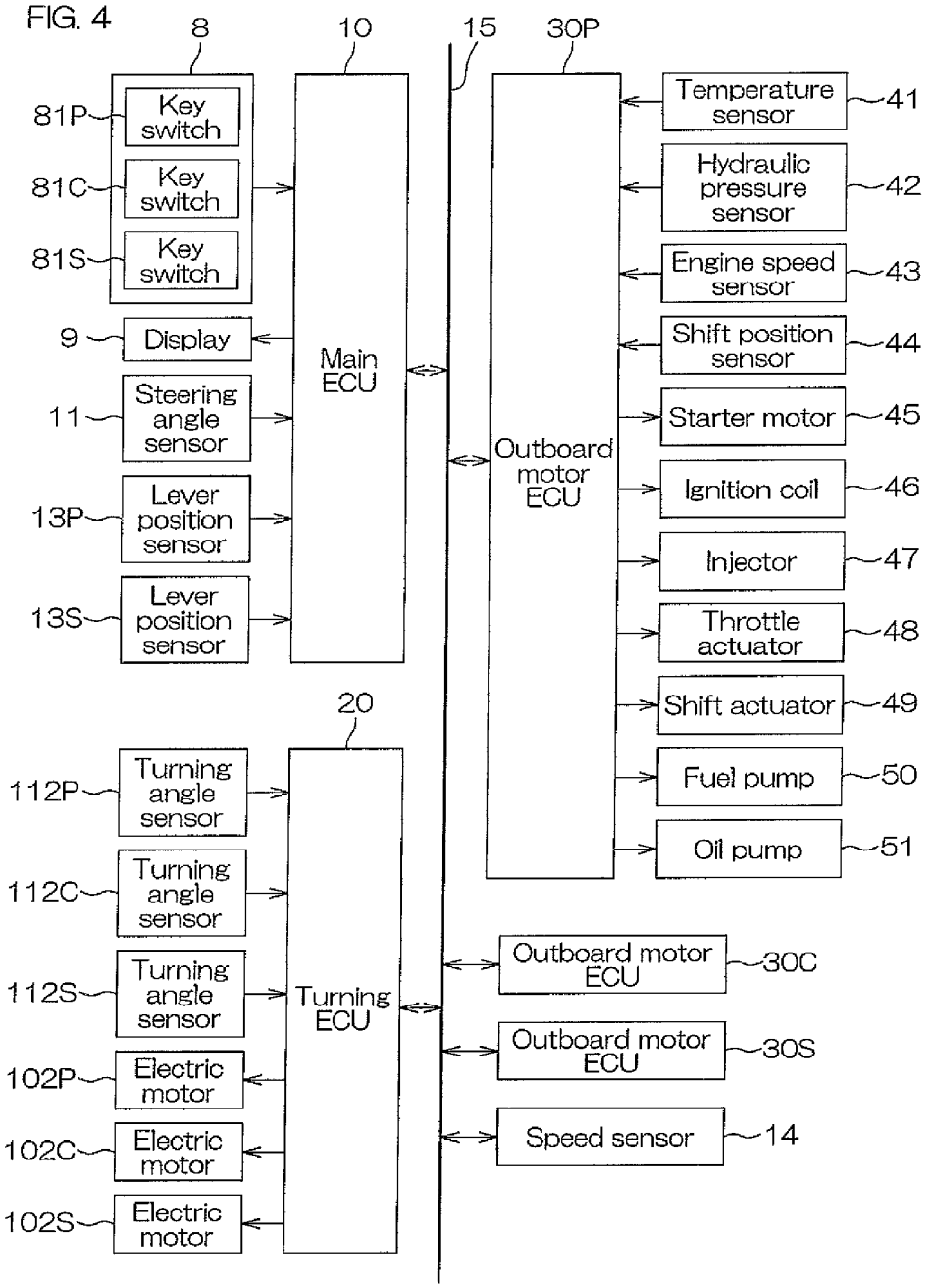
FIG. 4 is a block diagram for describing an electrical arrangement of a principal portion of the marine vessel.

A steering angle of the steering handle 6 is detected by a steering angle sensor 11 (see FIG. 4). Also, three turning mechanisms 12 (see FIG. 2 and FIG. 3), respectively corresponding to the three outboard motors 3, are provided at the stern. Each turning mechanism 12 includes an electric motor 102 (see FIG. 3) as a turning actuator driven in accordance with the steering angle detected by the steering angle sensor 11. The electric motors 102 of the three turning mechanisms 12 are controlled by a turning ECU 20 (see FIG. 4).

The steering apparatus 4 includes the steering handle 6, the steering angle sensor 11, the main ECU 10, the turning ECU 20, the three turning mechanisms 12, three turning angle sensors 112 (see FIG. 3 and FIG. 4) to be described below, etc. Due to the turning angle of each outboard motor 3 being controlled by the steering apparatus 4, a direction of the propulsive force is changed and a heading direction of the marine vessel 1 is changed accordingly.

The remote controller 7 includes two levers, i.e. right and left levers 7P and 7S. Each of these levers 7P and 7S can be inclined forward and rearward. When the two levers 7P and 7S are to be distinguished, the lever disposed at a left side facing the stem shall be referred to as the "left lever 7P" and the lever disposed at the right side facing the stem shall be referred to as the "right lever 7S."

Inclination positions of the levers 7P and 7S are respectively detected by potentiometers or other lever position sensors 13P and 13S (see FIG. 4). The lever position sensor 13P corresponds to the left lever 7P and the lever position sensor 13S corresponds to the right lever 7S.

The display 9 displays states of the outboard motors 3, an operation guidance screen, etc. The operation panel 8 includes three key switches 81P, 81C, and 81S ("key switch 81," when referred to collectively below) respectively corresponding to the three outboard motors 3P, 3C, and 3S.

The key switches 81P, 81C, and 81S are switches that are operated to turn on and off power supplies to the outboard motors 3P, 3C, and 3S, respectively, and to start the engines of the outboard motors 3P, 3C, and 3S, respectively. Specifically, by operating a key switch 81 from an off position to an on position, the power supply to the corresponding outboard motor 3 can be turned on. Further, by operating the key switch 81 from the on position to the start position, the engine of the corresponding outboard motor 3 can be started. Also, by operating the key switch 81 from the on position to the off position, the power supply to the corresponding outboard motor 3 can be put in the off state.

Figure 2:
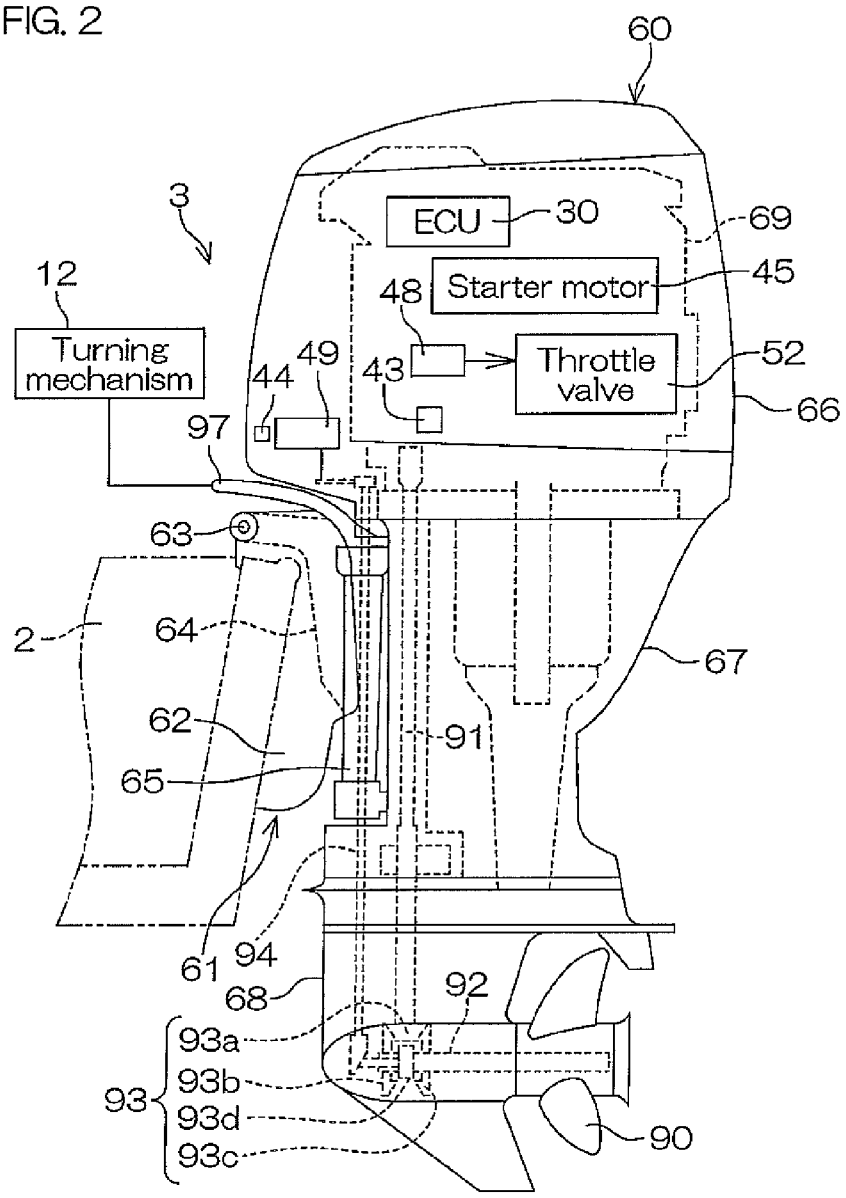
FIG. 2 is a schematic side view of an arrangement example of an outboard motor.

FIG. 2 is a schematic side view for describing an arrangement example in common to the three outboard motors 3.

Each outboard motor 3 includes a propulsion unit 60 and an attachment mechanism 61 to attach the propulsion unit 60 to the hull 2. The attachment mechanism 61 includes a clamp bracket 62 detachably fixed to a transom of the hull 2 and a swivel bracket 64 coupled to the clamp bracket 62 in a manner enabling pivoting around a tilt shaft 63 as a horizontal pivot axis. The propulsion unit 60 is attached to the swivel bracket 64 in a manner enabling pivoting around a steering shaft 65. Thus, a turning angle (a direction angle defined by the direction of the propulsive force with respect to a centerline of the hull 2) can be changed by pivoting the propulsion unit 60 around the steering shaft 65. Further, a trim angle of the propulsion unit 60 can be changed by pivoting the swivel bracket 64 around the tilt shaft 63. The trim angle is an angle of attachment of the outboard motor 3 with respect to the hull 2.

A housing of the propulsion unit 60 includes a top cowling 66, an upper case 67, and a lower case 68. An engine 69 is installed as a drive source in the top cowling 66 with an axis of a crankshaft thereof extending vertically. A driveshaft 91 for power transmission is coupled to a lower end of the crankshaft of the engine 69 and vertically extends through the upper case 67 into the lower case 68.

A propeller 90, which is a propulsive force generating member, is rotatably attached to a rear side of a lower portion of the lower case 68. A propeller shaft 92, which is a rotation shaft of the propeller 90, extends horizontally in the lower case 68. The rotation of the driveshaft 91 is transmitted to the propeller shaft 92 via a shift mechanism 93, which is a clutch mechanism.

The shift mechanism 93 includes a drive gear 93*a*, defined by a beveled gear fixed to a lower end of the driveshaft 91, a forward drive gear 93*b*, defined by a beveled gear rotatably disposed on the propeller shaft 92, a reverse drive gear 93*c*, likewise defined by a beveled gear rotatably disposed on the propeller shaft 92, and a dog clutch 93*d* disposed between the forward drive gear 93*b* and the reverse drive gear 93*c*.

The forward drive gear 93*b* is meshed with the drive gear 93*a* from a front side, and the reverse drive gear 93*c* is meshed with the drive gear 93*a* from a rear side. The forward drive gear 93*b* and the reverse drive gear 93*c* are thus rotated in mutually opposite directions.

The dog clutch 93*d* is in spline engagement with the propeller shaft 92. That is, the dog clutch 93*d* is axially slidable with respect to the propeller shaft 92, but is not rotatable relative to the propeller shaft 92 and thus rotates together with the propeller shaft 92.

The dog clutch 93*d* is slid along the propeller shaft 92 by axial pivoting of a shift rod 94 extending vertically parallel or substantially parallel to the driveshaft 91. The shift position of the dog clutch 93*d* is thus controlled to be set at a forward drive position at which it is engaged with the forward drive gear 93*b*, a reverse drive position at which it is engaged with the reverse drive gear 93*c*, or a neutral position at which it is not engaged with either the forward drive gear 93*b* or the reverse drive gear 93*c*.

When the dog clutch 93*d* is at the forward drive position, the rotation of the forward drive gear 93*b* is transmitted to the propeller shaft 92 via the dog clutch 93*d*. The propeller 90 is thus rotated in one direction (forward drive direction) to generate a propulsive force in a direction of moving the hull 2 forward. On the other hand, when the dog clutch 93*d* is at the reverse drive position, the rotation of the reverse drive gear 93*c* is transmitted to the propeller shaft 92 via the dog clutch 93*d*. The reverse drive gear 93*c* is rotated in a direction opposite to that of the forward drive gear 93*b*, and the propeller 90 is thus rotated in an opposite direction (reverse drive direction) to generate a propulsive force in a direction of moving the hull 2 in reverse. When the dog clutch 93*d* is at the neutral position, the rotation of the driveshaft 91 is not transmitted to the propeller shaft 92. That is, transmission path of a driving force between the engine 69 and the propeller 90 is cut off so that a propulsive force is not generated in either direction.

In relation to each engine 69, a starter motor 45 is disposed to start the engine 69. The starter motor 45 is controlled by the outboard motor ECU 30. Also, a throttle actuator 48 is provided to actuate a throttle valve 52 of the engine 69 to change a throttle opening degree and thus change an intake air amount of the engine 69. The throttle actuator 48 may include an electric motor. The operation of the throttle actuator 48 is controlled by the outboard motor ECU 30. The engine 69 further includes an engine speed sensor 43 to detect the rotation of the crankshaft so as to detect the rotational speed of the engine 69.

Also, in relation to the shift rod 94, a shift actuator 49 to change the shift position of the dog clutch 93*d* is provided. The shift actuator 49 includes, for example, an electric motor, and operation thereof is controlled by the outboard motor ECU 30. In relation to the shift actuator 49, a shift position sensor 44 that detects the shift position of the shift mechanism 93 is provided.

The turning mechanism 12 is coupled to a steering arm 97 fixed to the propulsion unit 60. By operating the turning mechanism 12, the propulsion unit 60 is pivoted to the right and left around the steering shaft 65 and steering of the marine vessel 1 can thus be performed.

FIG. 3 is an arrangement diagram of an arrangement of the turning mechanism.

The turning mechanism 12 is preferably a hydraulic turning mechanism. The turning mechanism 12 includes a hydraulic pump 101, an electric motor 102 to drive the hydraulic pump 101, and a hydraulic cylinder 103.

The hydraulic cylinder 103 is preferably a double-rod type double acting cylinder. The hydraulic cylinder 103 includes a cylinder tube 104, a piston 105 provided inside the cylinder tube 104, and a piston rod 106 connected to the piston 105. The cylinder tube 104 and the piston rod 106 extend in a right/left direction. A space inside the cylinder tube 104 is partitioned by the piston 105 into a first cylinder chamber 107 at the left side and a second cylinder chamber 108 at the right side. The piston 105 is capable of moving relatively to the right and left inside the cylinder tube 104. Actually, the right/left position of the piston 105 is fixed with respect to the hull 2 and the cylinder tube 104 moves to the right and left with respect to the piston 105.

The first cylinder chamber 107 is connected to a first port of the hydraulic pump 101 via a first oil passage 109. The second cylinder chamber 108 is connected to a second port of the hydraulic pump 101 via a second oil passage 110.

One end portion and another end portion of the piston rod 106 respectively project axially outward from one end portion and another end portion of the cylinder tube 104. The one end portion and the other end portion of the piston rod 106 are respectively coupled to two fixed arms 111. The two fixed arms 111 are fixed to the swivel bracket 64. The piston rod 106 is thus attached to the hull 2 via the swivel bracket 64 and the clamp bracket 62 (see FIG. 2). The cylinder tube 104 is coupled to the steering arm 97 fixed to the outboard motor 3. The cylinder tube 104 is guided by the piston rod 106 and is thus enabled to move in the right and left directions with respect to the hull 2. The outboard motor 3 pivots to the right and left around the steering shaft 65 in accompaniment with the movement of the cylinder tube 104 in the right and left directions.

In the description that follows, a turning angle midpoint of an outboard motor 3 is a position of the outboard motor 3 at which a rotation axis Ap of the propeller 90 of the outboard motor 3 is parallel or substantially parallel to a straight line extending in a front/rear direction of the hull 2 in a plan view. Also, a position of the cylinder tube 104 with respect to the hull 2 when the outboard motor 3 is positioned at the turning angle midpoint shall be referred to as the turning angle midpoint position of the cylinder tube 104.

The turning angle sensor 112 to detect the actual turning angle of the outboard motor 3 is provided in a vicinity of the hydraulic cylinder 103. The turning angle sensor 112 detects an amount of movement of the cylinder tube 104 in both the right and left directions from the turning angle midpoint position of the cylinder tube 104. The turning angle sensor 112, for example, outputs the amount of movement of the cylinder tube 104 in the left direction from the turning angle midpoint position as a positive value and outputs the amount of movement in the right direction from the turning angle midpoint position as a negative value. The turning angle of the outboard motor 3 is detected based on the movement amount of the cylinder tube 104 from the turning angle midpoint position that is detected by the turning angle sensor 112.

When the turning angle sensors 112 provided in the turning mechanisms 12 of the respective outboard motors 3P, 3C, and 3S are to be distinguished, the turning angle sensor corresponding to the port outboard motor 3P shall be referred to as the "turning angle sensor 112P," the turning angle sensor corresponding to the central outboard motor 3C shall be referred to as the "turning angle sensor 112C," and the turning angle sensor corresponding to the starboard outboard motor 3S shall be referred to as the "turning angle sensor 112S."

A first pilot check valve 113 is provided in a middle of the first oil passage 109. A second pilot check valve 114 is provided in a middle of the second oil passage 110. A pilot port of the first pilot check valve 113 is connected to a portion in the second oil passage 110 between the hydraulic pump 101 and the second pilot check valve 114. A pilot port of the second pilot check valve 114 is connected to a portion in the first oil passage 109 between the hydraulic pump 101 and the first pilot check valve 113.

The first pilot check valve 113 and the second pilot check valve 114 allow oil to flow through from the hydraulic pump 101 side to the hydraulic cylinder 103 side and blocks the flow of oil from the hydraulic cylinder 103 side to the hydraulic pump 101 side. However, each of the pilot check valves 113 and 114 is put in a state enabling reverse flow (flow through of oil from the hydraulic cylinder 103 side to the hydraulic pump 101 side) when a pilot pressure thereof become no less than a predetermined value.

The first oil passage 109 and the second oil passage 110 are connected, at portions closer to the hydraulic cylinder 103 than to the pilot check valves 113 and 114, by a bypass oil passage 116 including a bypass valve 115. In the present preferred embodiment, the bypass valve 115 is a manually opened/closed bypass valve that is opened and closed manually and is normally in a closed state.

The first port of the hydraulic pump 101 is further connected via a first check valve 117 to an oil tank 121 and connected via a first relief valve 118 to the oil tank 121. Likewise, the second port of the hydraulic pump 101 is connected via a second check valve 119 to the oil tank 121 and connected via a relief valve 120 to the oil tank 121.

The electric motor 102 is driven to rotate in a forward rotation direction or a reverse rotation direction to drive the hydraulic pump 101. Specifically, an output shaft of the electric motor 102 is coupled to an input shaft of the hydraulic pump 101 and by rotation of the output shaft of the electric motor 102, the input shaft of the hydraulic pump 101 is rotated to achieve driving of the hydraulic pump 101. The electric motor 102 is, for example, a DC motor. When the electric motors 102 provided in the turning mechanisms 12 of the respective outboard motors 3P, 3C, and 3S are to be distinguished, the electric motor corresponding to the port outboard motor 3P shall be referred to as the "electric motor 102P," the electric motor corresponding to the central outboard motor 3C shall be referred to as the "electric motor 102C," and the electric motor corresponding to the starboard outboard motor 3S shall be referred to as the "electric motor 102S."

When the electric motor 102 is rotated in the forward rotation direction, the hydraulic pump 101 is rotated forwardly and, for example, oil inside the oil tank 121 is sucked into the hydraulic pump 101 via the second check valve 119 and discharged from the hydraulic pump 101 to the first oil passage 109. The oil discharged to the first oil passage 109 is supplied via the first pilot check valve 113 and the first oil passage 109 to the first cylinder chamber 107 of the hydraulic cylinder 103. The cylinder tube 104 is thus moved in the left direction with respect to the hull 2 so that a volume of the first cylinder chamber 107 increases. Due to this process, the pilot pressure input into the second pilot check valve 114 becomes no less than the predetermined pressure and thus the second pilot check valve 114 is put in the state enabling reverse flow. The oil inside the second cylinder chamber 108 is thus sucked via the second oil passage 110 and the second pilot check valve 114 into the hydraulic pump 101.

When the electric motor 102 is rotated in the reverse rotation direction, the hydraulic pump 101 is rotated reversely and the oil inside the oil tank 121 is sucked into the hydraulic pump 101 via the first check valve 117 and discharged from the hydraulic pump 101 to the second oil passage 110. The oil discharged to the second oil passage 110 is supplied via the second pilot check valve 114 and the second oil passage 110 to the second cylinder chamber 108 of the hydraulic cylinder 103. The cylinder tube 104 is thus moved in the right direction with respect to the hull 2 so that a volume of the second cylinder chamber 108 increases. Due to this process, the pilot pressure input into the first pilot check valve 113 becomes no less than the predetermined pressure and thus the first pilot check valve 113 is put in the state enabling reverse flow. The oil inside the first cylinder chamber 107 is thus sucked via the first oil passage 109 and the first pilot check valve 113 into the hydraulic pump 101.

When the rotation of the electric motor 102 is stopped and the hydraulic pump 101 is not driven, the flow through of oil inside the cylinder chambers 107 and 108 of the hydraulic cylinder 103 is disabled by the pilot check valves 113 and 114. The movement of the cylinder tube 104 is thus disabled and the outboard motor 3 is put in a state of not being able to pivot around the steering shaft 65 (state of being fixed in turning angle). When in this state, the bypass valve 115 is opened, the hydraulic chambers 107 and 108 of the hydraulic cylinder 103 are put in communication with each other via the oil passages 109, 115, and 110 and flow through of oil between the cylinder chambers 107 and 108 is enabled. The outboard motor 3 is thus put in a state of being able to pivot freely around the steering shaft 65 (freely turning state). When the bypass valve 115 is opened, even when the electric motor 102 is driven, the hydraulic cylinder 103 is not actuated.

FIG. 4 is a diagram for describing an electrical arrangement of a principal portion of the marine vessel 1.

The operation panel 8, the display 9, the steering angle sensor 11, and the lever position sensors 13P and 13S are connected to the main ECU 10. The main ECU 10 includes a computer (microcomputer). The main ECU 10 is connected to a bus 15 that defines an inboard LAN (local area network). Also, a speed sensor 14 to detect a speed of the marine vessel 1 is connected to the bus 15.

The outboard motors 3S, 3C, and 3P include outboard motor ECUs 30S, 30C, and 30P, respectively. The outboard motor ECU 30P corresponds to the port outboard motor 3P, the outboard motor ECU 30C corresponds to the central outboard motor 3C, and the outboard motor ECU 30S corresponds to the starboard outboard motor 3S. The outboard motor ECUs 30S, 30C, and 30P are connected to the bus 15. The outboard motor ECUs 30S, 30C, and 30P are practically the same in internal arrangement and shall be referred to as the "outboard motor ECU 30" when referred to collectively below.

Each outboard motor ECU 30 includes a computer (microcomputer). A temperature sensor 41, a hydraulic pressure sensor 42, the engine speed sensor 43, the shift position sensor 44, a starter motor 45, an ignition coil 46, an injector 47, the throttle actuator 48, the shift actuator 49, a fuel pump 50, an oil pump 51, etc., are connected to the outboard motor ECU 30.

The starter motor 45 is a device to perform cranking of the engine. The injector 47 is a device that injects fuel into an air intake path of the engine. The throttle actuator 48 is a device that controls the throttle valve 52 to adjust the amount of air supplied to the air intake path of the engine. The ignition coil 46 is a device that increases a voltage applied to a spark plug (not shown). The spark plug is a device that discharges inside a combustion chamber of the engine to ignite a mixed gas inside the combustion chamber. The shift actuator 49 is a device that drives the shift mechanism 93 of the outboard motor. The fuel pump 50 is a device that pumps out fuel from a fuel tank (not shown) to supply the fuel to the injector 47. The oil pump 51 is a device that circulates engine oil inside the engine.

The temperature sensor 41 detects a temperature of cooling water in the engine. The hydraulic pressure sensor 42 detects a pressure of the engine oil. The engine speed sensor 43 detects the rotational speed of the engine. The shift position sensor 44 detects the shift position of the shift mechanism 93 (shift position of the outboard motor).

The electric motors 102P, 102C, and 102S and the turning angle sensors 112P, 112C, and 112S of the turning mechanisms 12 respectively corresponding to the outboard motors 30P, 30C, and 30S are connected to the turning ECU 20. The turning ECU 20 is connected to the bus 15. The turning ECU 20 includes drive circuits to drive the respective electric motors 102P, 102C, and 102S and a computer (microcomputer) to control the drive circuits.

The computer of the main ECU 10 executes programs to achieve the functions of a plurality of function processing units. The function processing units include an electric power supply/starting control unit, a shift position etc., computing unit, a basic target turning angle computing unit, and a malfunction operation control unit.

Functions of the main ECU 10 as the electric power supply/starting control unit include performing, on the basis of an operation signal from a key switch 81 on the operation panel 8, on/off control of the electric power supply of the corresponding outboard motor 3 and starting control of the engine of the corresponding outboard motor 3. Functions of the main ECU 10 as the shift position etc., computing unit include performing a shift position etc., computing process of computing target shift positions and target engine speeds of the respective outboard motors 3 based on outputs of the lever position sensors 13P and 13S. Functions of the main ECU 10 as the basic target turning angle computing unit include performing a basic target turning angle computing process of computing basic target turning angles of the respective outboard motors 3 based on an output of the steering angle sensor 11. Functions of the main ECU 10 as the malfunction operation control unit include performing a malfunction operation control process when there is a malfunction in the turning angle control of any of the outboard motors 3.

These functions shall now be described in detail.

The functions of the main ECU 10 as the electric power supply/starting control unit areas follows. That is, when a key switch 81 is operated from the off position to the on position, the main ECU 10 turns on the electric power supply of the corresponding outboard motor ECU 30. Also, when the key switch 81 is operated from the on position to the off position, the main ECU 10 turns off the electric power supply of the corresponding outboard motor 3. Also, when the key switch 81 is operated from the on position to the start position, the main ECU 10 outputs an engine starting command to the corresponding outboard motor ECU 30 under a condition that the starting allowing conditions are met. The starting allowing conditions include the target shift position of the outboard motor 3, computed by the main ECU 10, is the neutral position and the actual shift position of the shift mechanism 93 of the corresponding outboard motor 3 is the neutral position. Information on the shift position of the shift mechanism 93 of each outboard motor 3 is sent from the corresponding outboard motor ECU 30 to the main ECU 10 via the bus 15.

Upon receiving the engine starting command, the outboard motor ECU 30 performs an engine starting process. In the engine starting process, the outboard motor ECU 30 drives the starter motor 45, the ignition coil 46, and the injector 47 to perform fuel supply control and ignition control to start the engine.

Functions of the main ECU 10 as the shift position etc., computing unit shall now be described. Based on the output signals of the lever position sensors 13S and 13P, the main ECU 10 computes the target shift positions and the target engine speeds for the respective outboard motors 3 and transmits these to the corresponding outboard motor ECUs 30. Each outboard motor ECU 30 controls the shift position and the engine speed of the corresponding outboard motor 3 based on the target shift position and the target engine speed that are transmitted from the main ECU 10. Specifically, the outboard motor ECU 30 controls the shift actuator 49 so that the shift position of the outboard motor 3 becomes the target shift position and controls the throttle actuator 48 so that the engine speed becomes the target engine speed. Such control shall now be described in detail.

The shift position of each outboard motor 3 is controlled as follows. In the present preferred embodiment, the left lever 7P is associated with the port outboard motor 3P, the right lever 7S is associated with the starboard outboard motor 3S, and both levers 7P and 7S are associated with the central outboard motor 3C.

When the left lever 7P is inclined forward by no less than a predetermined amount from a predetermined neutral position, the shift position of the port outboard motor 3P is set to the forward drive position and a propulsive force in the forward drive direction is generated from the corresponding outboard motor 3P. The target engine speed is set at an idling engine speed up to the inclination position of the predetermined amount (forward drive shift-in position). When the left lever 7P is inclined forward beyond the forward drive shift-in position, the target engine speed increases as the lever inclination amount increases. When the left lever 7P is inclined rearward by no less than a predetermined amount from the neutral position, the shift position of the port outboard motor 3P is set at the reverse drive position and a propulsive force in the reverse drive direction is generated from the port outboard motor 3P. The target engine speed is set at the idling engine speed up to the inclination position of the predetermined amount (reverse drive shift-in position). When the left lever 7P is inclined rearward beyond the reverse drive shift-in position, the target engine speed increases as the lever inclination amount increases. When the left lever 7P is at the neutral position, the shift position of the port outboard motor 3P is set at the neutral position and the outboard motor 3P does not generate a propulsive force.

When the right lever 7S is operated, the shift position and the engine speed of the starboard outboard motor 3S are controlled in the same manner as in the above-described control of the shift position and the engine speed of the port outboard motor 3P that is performed when the left lever 7P is operated.

Further, the shift position of the central outboard motor 3C is controlled as follows according to the operations of both levers 7P and 7S. That is, when the levers 7P and 7S are both inclined forward to no less than the forward drive shift-in positions from the neutral positions, the shift position of the central outboard motor 3C is set at the forward drive position and a propulsive force in the forward drive direction is generated from the central outboard motor 3C. When the levers 7P and 7S are both inclined rearward to no less than the reverse drive shift-in positions from the neutral positions, the shift position of the central outboard motor 3C is controlled to be at the reverse drive position and a propulsive force in the reverse drive direction is generated from the central outboard motor 3C.

The target engine speed is set to the idling engine speed if the inclination positions of both levers 7P and 7S are between the forward drive shift-in positions and the reverse drive shift-in positions. When the lever inclination positions are outside the ranges between both shift-in positions, the target engine speed is set according to the inclination amounts of both levers 7P and 7S.

If at least one of either of the levers 7P and 7S is at the neutral position, the shift position of the central outboard motor 3C is set at the neutral position. The shift position of the central outboard motor 3C is also set at the neutral position when one of the levers is inclined forward from the neutral position (for example, inclined forward relative to the forward drive shift-in position) and the other lever is inclined rearward from the neutral position (for example, inclined rearward relative to the reverse drive shift-in position).

FIGS. 5A-5F are schematic views for describing relationships of the respective lever positions and movements of a hull.

Figures 5A, 5B, 5C, 5D, 5E, 5F:
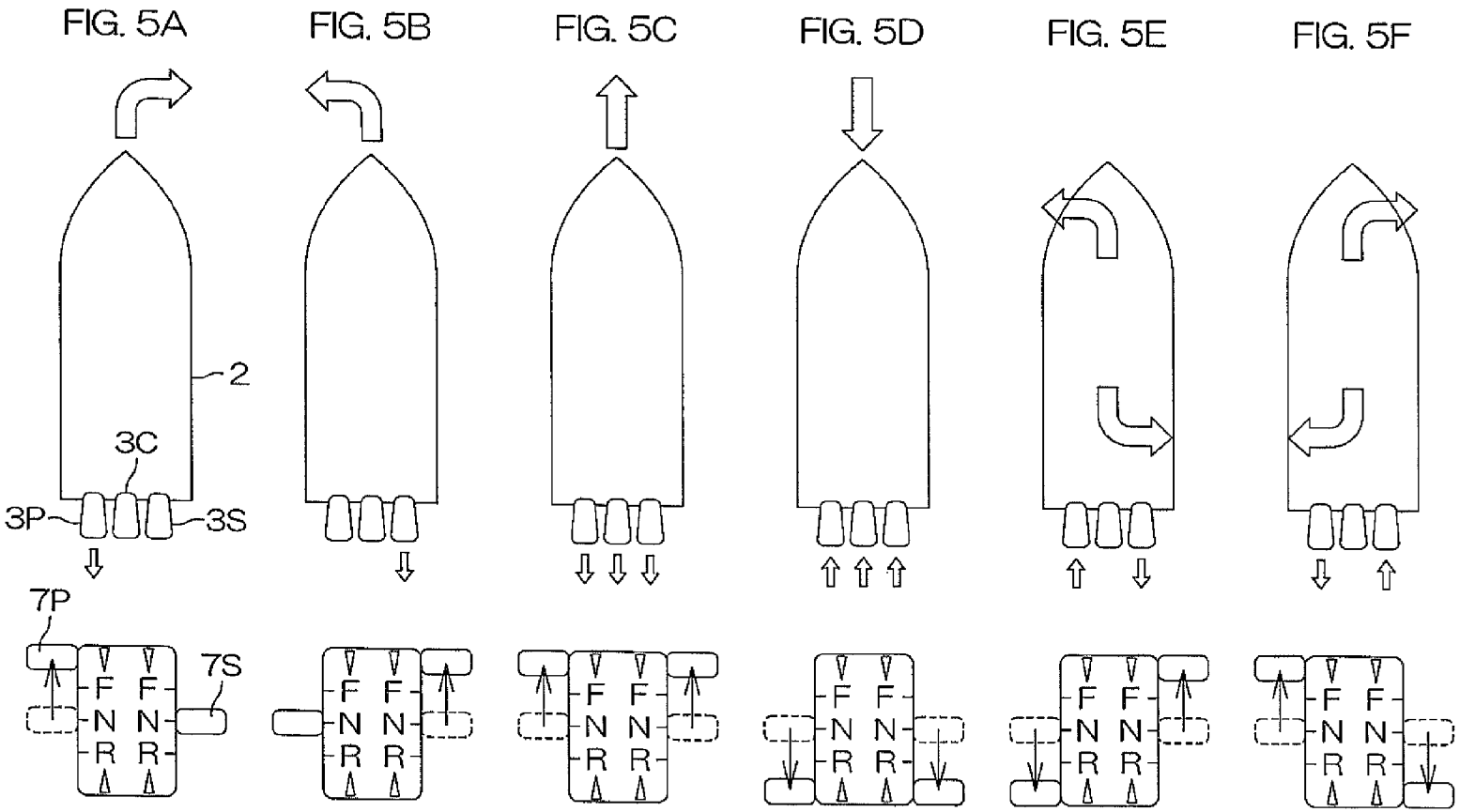
FIGS. 5A to 5F are schematic views for describing relationships of respective lever positions to adjust a propulsive force of the marine vessel and movements of a hull.

When as shown in FIG. 5A, the left lever 7P is inclined forward (to an F side) relative to the neutral position and the right lever 7S is at the neutral position, the shift position of the port outboard motor 3P is set at the forward drive position and the shift positions of the other outboard motors 3C and 3S are set at the neutral positions. The hull 2 thus receives only the forward drive direction propulsive force of the port outboard motor 3P and thus turns in the right direction.

When as shown in FIG. 5B, the right lever 7S is inclined forward (to the F side) relative to the neutral position and the left lever 7P is at the neutral position, the shift position of the starboard outboard motor 3S is set at the forward drive position and the shift positions of the other outboard motors 3P and 3C are set at the neutral positions. The hull 2 thus receives only the forward drive direction propulsive force of the starboard outboard motor 3S and thus turns in the left direction.

When as shown in FIG. 5C, both levers 7P and 7S are inclined forward (to the F side) relative to the neutral positions, the shift positions of all three outboard motors 3 are set at the forward drive positions. The hull 2 is thus driven forward by the forward drive direction propulsive forces of all three outboard motors 3.

When as shown in FIG. 5D, both levers 7P and 7S are inclined rearward (to an R side) relative to the neutral positions, the shift positions of all three outboard motors 3 are set at the reverse drive positions. The hull 2 is thus driven in reverse by the reverse drive direction propulsive forces of all three outboard motors 3.

FIG. 5E shows a state where the left lever 7P is inclined rearward (to the R side) relative to the neutral position and the right lever 7S is inclined forward (to the F side) relative to the neutral position. In this case, the shift position of the port outboard motor 3P is set at the reverse drive position, the shift position of the starboard outboard motor 3S is set at the forward drive position, and the shift position of the central outboard motor 3C is set at the neutral position. The hull 2 is thus turned to the left by the reverse drive direction propulsive force of the port outboard motor 3P and the forward drive direction propulsive force of the starboard outboard motor 3S.

FIG. 5F shows a state where the left lever 7P is inclined forward (to the F side) relative to the neutral position and the right lever 7S is inclined rearward (to the R side) relative to the neutral position. In this case, the shift position of the port outboard motor 3P is set at the forward drive position, the shift position of the starboard outboard motor 3S is set at the reverse drive position, and the shift position of the central outboard motor 3C is set at the neutral position. The hull 2 is thus turned to the right by the forward drive direction propulsive force of the port outboard motor 3P and the reverse drive direction propulsive force of the starboard outboard motor 3S.

The functions of the main ECU 10 as the basic target turning angle computing unit and as the malfunction operation control unit shall be described below.

The computer of each outboard motor ECU 30 executes programs to achieve the functions of a plurality of function processing units. The plurality of function processing units include an engine starting process unit, a shift control unit, etc. A function of the outboard motor ECU 30 as the engine starting process unit is to perform the engine starting process. A function of the outboard motor ECU 30 as a shift control unit is to control the engine speed and the shift position based on the target engine speed and the target shift position computed by the main ECU 10.

The computer of the turning ECU 20 executes programs to achieve the functions of a plurality of function processing units. The plurality of function processing units include a motor control unit, a malfunction monitoring unit, etc. A function of the turning ECU 20 as the motor control unit is to perform a motor control process to control the electric motors 102 of the turning mechanisms 12 of the respective outboard motors 3 based on the basic target turning angle computed by the main ECU 10. A function of the turning ECU 20 as the malfunction monitoring unit is to monitor whether or not there is a malfunction in the turning angle control of the respective outboard motors 3.

The function of the main ECU 10 as the basic target turning angle computing unit and the function of the turning ECU 20 as the motor control unit shall now be described with reference to FIG. 6.

Figure 6:
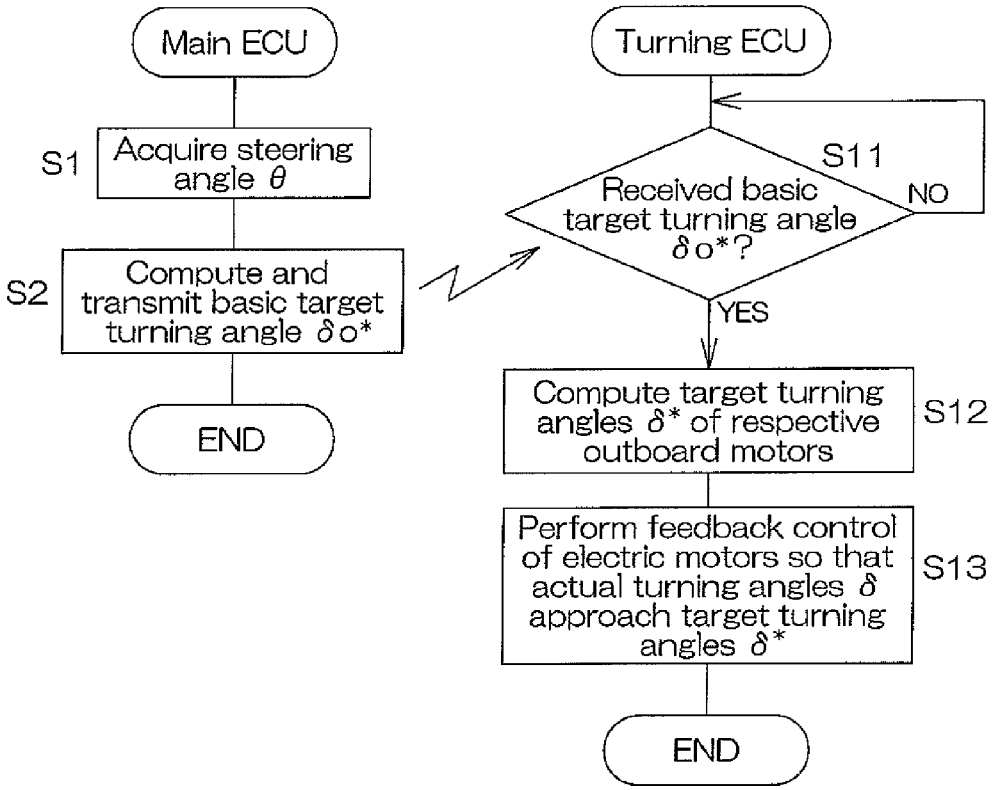
FIG. 6 is a flowchart of procedures of a basic target turning angle computing process performed by a main ECU and procedures of a motor control process performed by a turning ECU.

FIG. 6 is a flowchart of procedures of the basic target turning angle computing process performed by the main ECU 10 and procedures of the motor control process performed by the turning ECU 20. The reference target turning angle computing process and the motor control process shown in FIG. 6 are performed repeatedly at every predetermined computation cycle.

The main ECU 10 acquires a steering angle θ based on the output of the steering angle sensor 11 (step S1). The main ECU 10 then computes a basic target turning angle δo* in common to all of the outboard motors 3 based on the acquired steering angle θ and transmits it to the turning ECU 20 (step S2). The main ECU 10, for example, computes the basic target turning angle δo* corresponding to the acquired steering angle θ based on a map by which a relationship of the steering angle θ and the basic target turning angle δo* is stored in advance.

Upon receiving the basic target turning angle δo* transmitted from the main ECU 10 (step S11: YES), the turning ECU 20 computes target turning angles δ* of the respective outboard motors 3 based on the received basic target turning angle δo* (step S12). For example, the turning ECU 20 computes the target turning angles δ* of the respective outboard motors 3 corresponding to the received basic target turning angle δo* based on a map by which a relationship of the basic target turning angle δo* and the target turning angles δ* of the respective outboard motors 3 is stored in advance. The turning ECU 20 may use the received basic target turning angle δo* as it is as the target turning angle δ* of each outboard motor 3.

Thereafter, the turning ECU 20 uses the target turning angle δ* of each outboard motor 3 to perform feedback control of the electric motor 102 of the turning mechanism 12 of the corresponding outboard motor 3 (step S13). Specifically, the turning ECU 20 drives the electric motor 102 of the turning mechanism 12 of each outboard motor 3 so that the actual turning angle δ of the corresponding outboard motor 3 detected by the turning angle sensor 112 approaches the target turning angle δ* of the corresponding outboard motor 3. The turning angles of the respective outboard motors 3 are thus controlled in accordance with the steering angle of the steering handle 6.

Details of the functions of the steering ECU 20 as the malfunction monitoring unit are as follows. When in a certain outboard motor 3 there is a malfunction of the turning mechanism 12 or the turning angle sensor 112, the actual turning angle δ corresponding to the outboard motor 3 does not converge to the target turning angle δ* corresponding to the outboard motor 3. The turning ECU 20 thus monitors, for each outboard motor 3, whether or not a state where a difference between the actual turning angle δ and the target turning angle δ* is greater than a predetermined value has continued for no less than a predetermined time. When for a certain outboard motor 3 the state where the difference between the actual turning angle δ and the target turning angle δ* is greater than a predetermined value has continued for no less than the predetermined time, the turning ECU 20 judges that there is a malfunction in the turning angle control of the outboard motor 3 and provides notification of this condition to the main ECU 10.

The functions of the main ECU 10 as the malfunction operation control unit shall now be described.

Figure 7A:
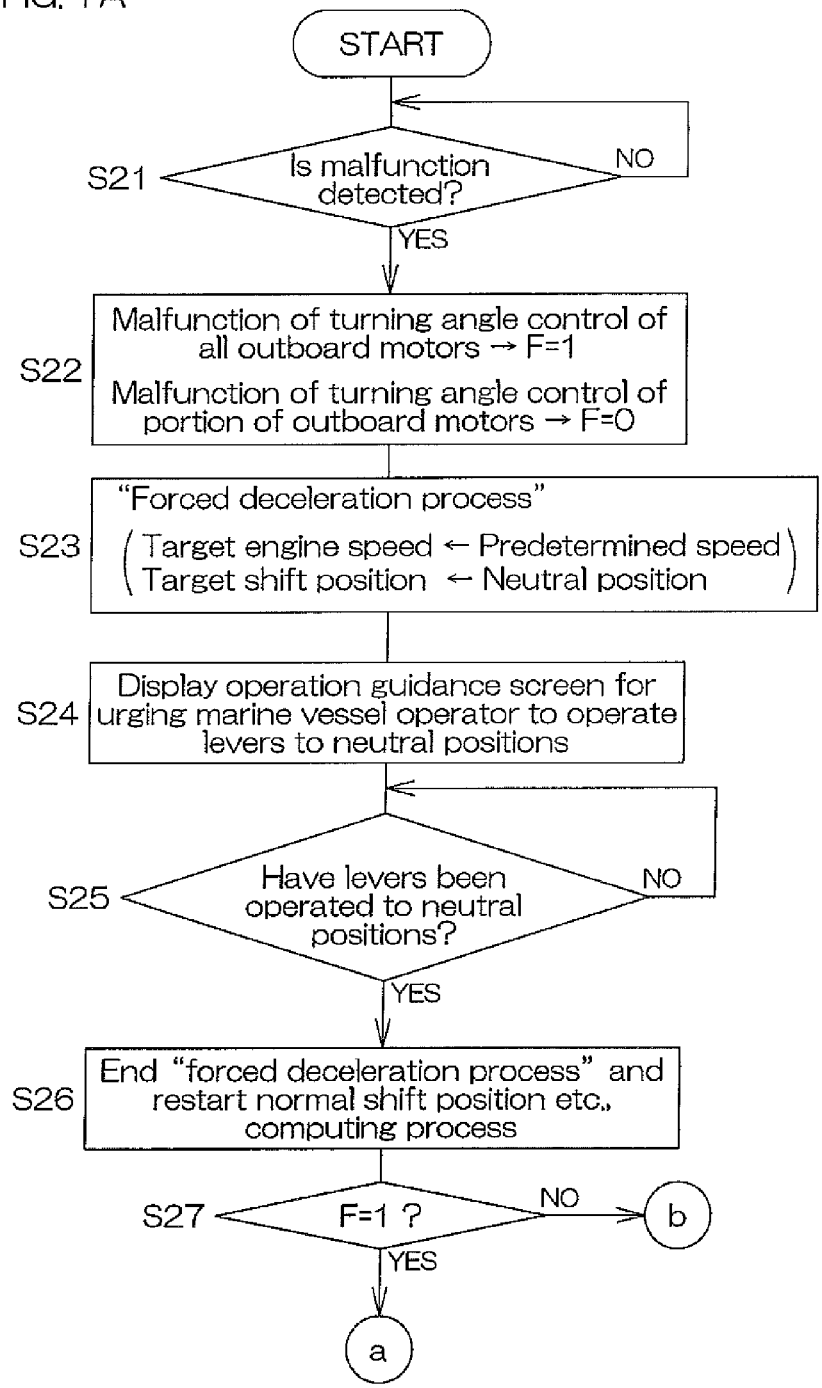
FIG. 7A is a flowchart of a portion of procedures of a malfunction operation control process executed by the main ECU.
Figure 7B:
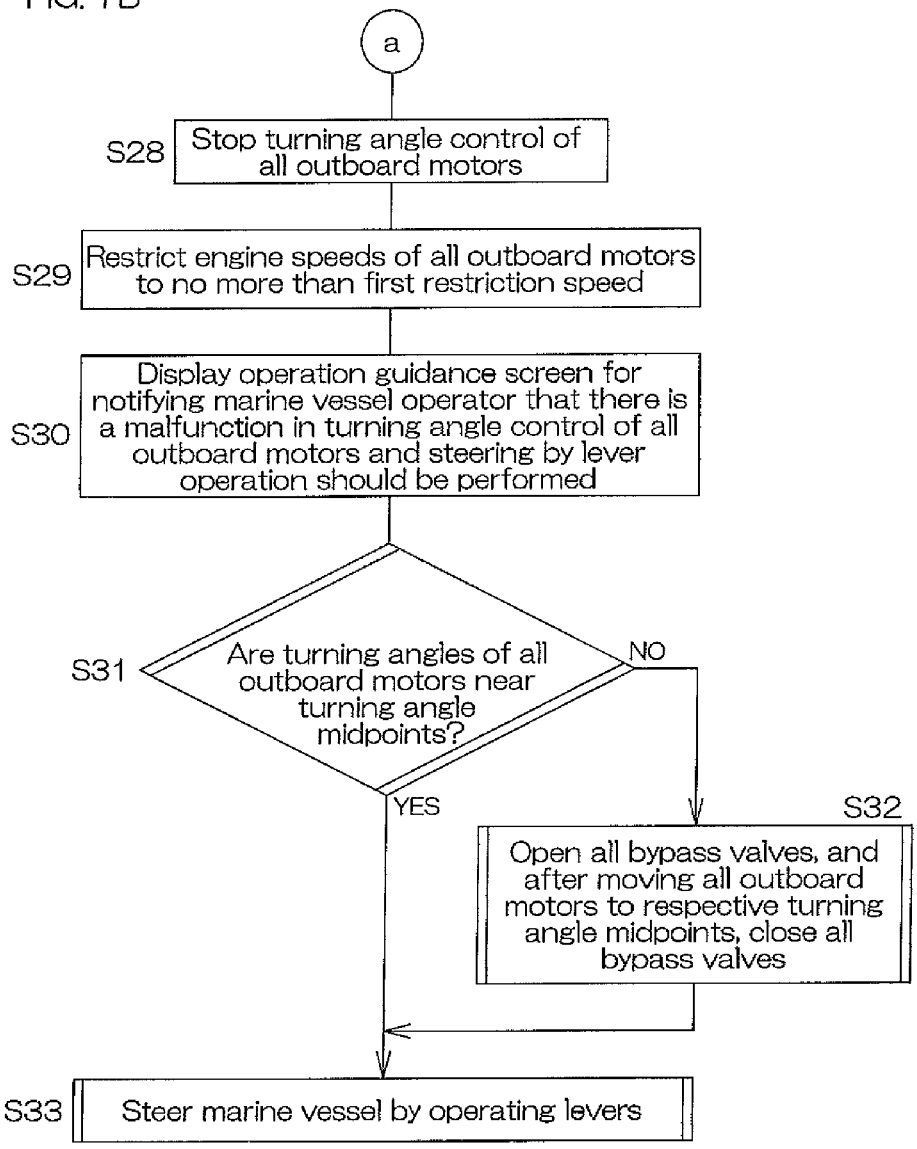
FIG. 7B is a flowchart of a portion of the procedures of the malfunction operation control process executed by the main ECU.
Figure 7C:
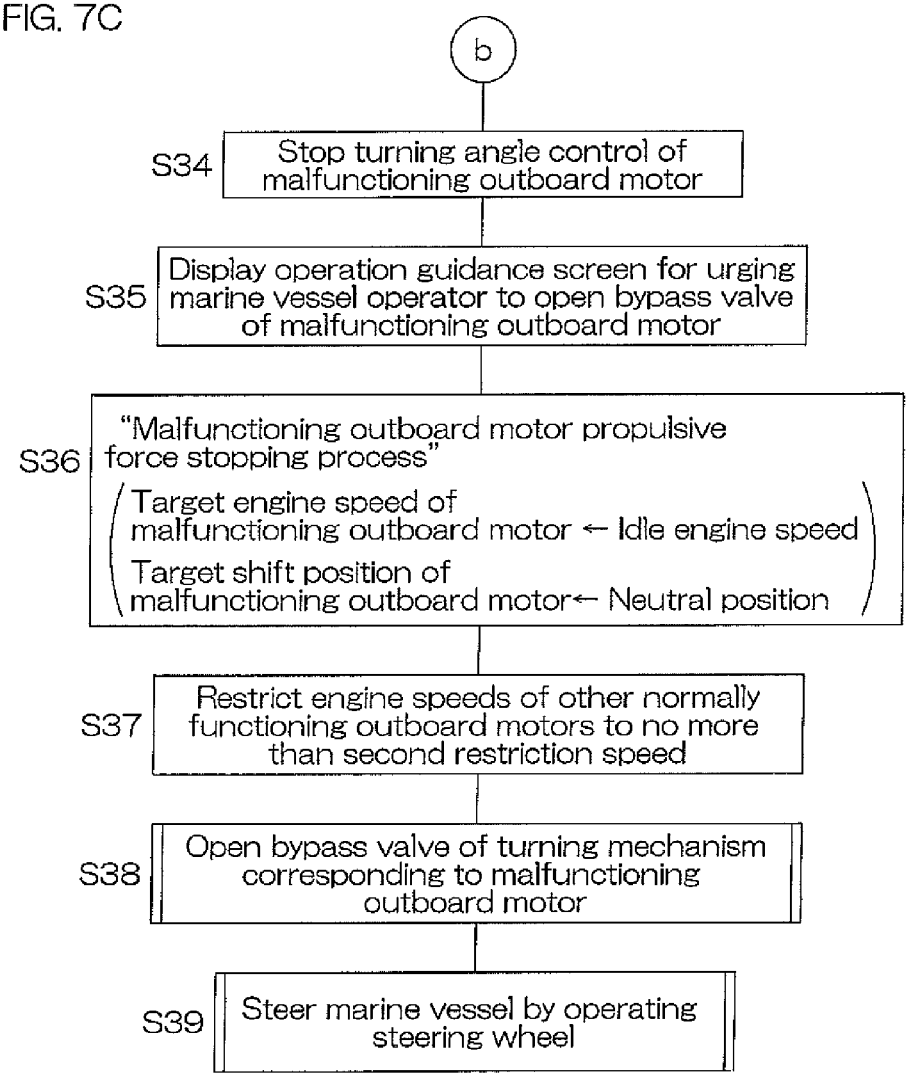
FIG. 7C is a flowchart of a portion of the procedures of the malfunction operation control process executed by the main ECU.

FIG. 7A, FIG. 7B, and FIG. 7C are flowcharts of procedures of the malfunction operation control process executed by the main ECU 10.

The main ECU 10 monitors whether or not there is a malfunction in the turning angle control of each outboard motor 3 (step S21). Malfunctions in the turning angle control of an outboard motor 3 include a malfunction of the steering angle sensor 11, a malfunction of the turning mechanism 12, a malfunction of the turning angle sensor 112, etc. A malfunction of the steering angle sensor 11 is included among malfunctions due to an input system in common to all turning mechanisms 12. A malfunction of the turning mechanism 12 or a malfunction of the turning angle sensor 112 is included among malfunctions due to output systems of the respective turning mechanisms 12.

When there is a malfunction of the steering angle sensor 11, the output signal of the steering angle sensor 11 is fixed at a predetermined value. The main ECU 10 can thus detect the malfunction of the steering angle sensor 11 (including disconnection of a signal line of the steering angle sensor 11) by monitoring the output signal of the steering angle sensor 11. When the malfunction of the steering angle sensor 11 is detected, the turning angle control of none of the outboard motors 3 can be performed and thus the main ECU 10 judges that there is a malfunction in the turning angle control of all of the outboard motors 3.

In a case where there is a malfunction in the turning angle control of any of the outboard motors 3 due to a malfunction, etc., of a turning mechanism 12 or a turning angle sensor 112, a notification of this condition is provided from the turning ECU 20 to the main ECU 10 as mentioned above. The main ECU 10 can thus detect that there is a malfunction in the turning angle control of any of the outboard motors 3 and can recognize the outboard motor 3 with the malfunction in the turning angle control.

Upon detecting that there is a malfunction in the turning angle control of any of the outboard motors 3 among the three outboard motors 3 (step S21: YES), the main ECU 10 enters step S22. In step S22, the main ECU 10 judges whether there is a malfunction in the turning angle control of all outboard motors 3 or there is a malfunction in the turning angle control of one of the outboard motors 3 and stores the judgment result (step S22). Specifically, the main ECU 10 sets an all-outboard-motor malfunction flag F (F=1) if it judges that there is a malfunction in the turning angle control of all outboard motors 3 and resets the all-outboard-motor malfunction flag F (F=0) if it judges that there is a malfunction in the turning angle control of one of the outboard motors 3.

Thereafter, the main ECU 10 performs a process to forcibly decelerate a traveling speed of the marine vessel 1 (this process may hereinafter be referred to at times as the "forced deceleration process") (step S23). Specifically, the main ECU 10 fixes the target engine speeds for all outboard motors 3 at a predetermined speed regardless of the positions of the levers 7P and 7S and fixes the target shift positions for all outboard motors 3 at the neutral positions regardless of the positions of the levers 7P and 7S. The predetermined speed is set, for example, to an idling engine speed. The fixing of the target engine speed at the predetermined speed may also be performed by forcibly closing the throttle valves 52 fully.

Accordingly, at each outboard motor ECU 30, a control of setting the engine speed of the corresponding outboard motor 3 at the predetermined speed and a control of setting the shift position of the corresponding outboard motor 3 at the neutral position are performed. The power transmission between the engine 69 and the propeller 90 is thus interrupted in all outboard motors 3 so that the generation of a propulsive force by all outboard motors 3 is stopped and the traveling speed of the marine vessel 1 is decelerated.

Figure 8:
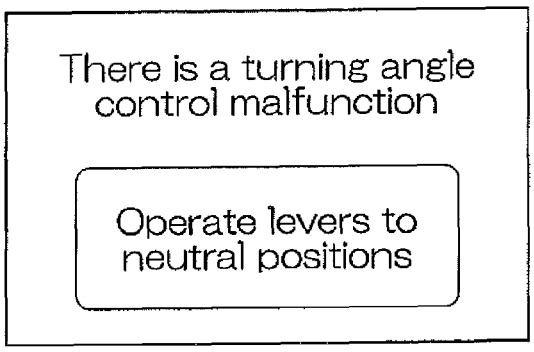
FIG. 8 is a schematic view of an example of an operation guidance screen displayed on a display in step S24 of FIG. 7A.

Also, the main ECU 10 displays, on the display 9, an operation guidance screen to urge the marine vessel operator to operate the levers 7P and 7S to the neutral positions (step S24). An example of the operation guidance screen displayed on the display in step S24 is shown in FIG. 8. The operation guidance screen includes the emergency message: "There is a turning angle control malfunction." and the operation guidance: "Operate the levers to the neutral positions." The main ECU 10 waits for the levers 7P and 7S to be operated to the neutral positions (step S25). Whether or not the levers 7P and 7S have been operated to the neutral positions is judged based on the output signals of the lever position sensors 13P and 13S.

Figure 11A:
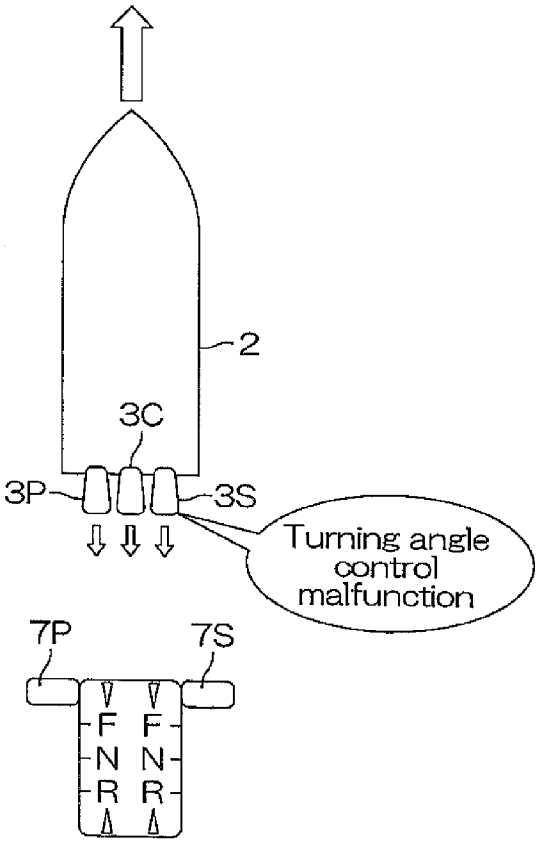
FIGS. 11A to 11C are schematic views for specifically describing a process of steps S21 to S25 of FIG. 7A.
Figure 11B:
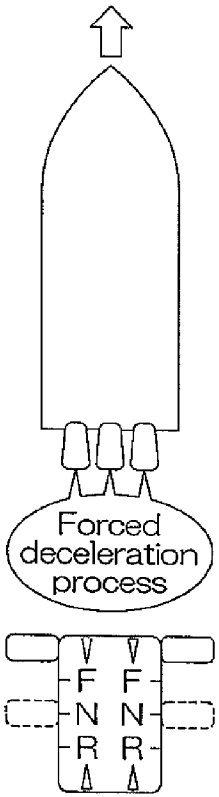
Figure 11C:
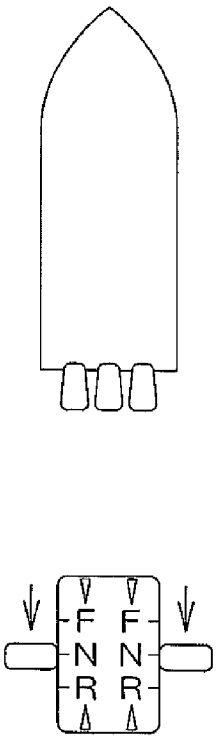

FIGS. 11A-11C are schematic views for specifically describing the process of steps S21 to S25.

As shown in FIG. 11A, a case where there is a malfunction in the turning angle control of the starboard outboard motor 3S in a state where all three of the outboard motors 3 are generating propulsive forces in the forward drive direction and the hull 2 is being driven forward shall be presumed. In this case, the main ECU 10 detects that there is a malfunction in the turning angle control of the starboard outboard motor 3S and resets the all-outboard-motor malfunction flag (F=0). Also, the main ECU 10 performs the "forced deceleration process." The engine speeds of all outboard motors 3 are thus set at the predetermined speed regardless of the positions of the levers 7P and 7S and the shift positions of all outboard motors 3 are set at the neutral positions as shown in FIG. 11B. Also, the main ECU 10 displays the operation guidance screen, such as shown in FIG. 8, on the display 9. The marine vessel operator operates the levers 7P and 7S to the neutral positions as shown in FIG. 11C in accordance with the operation guidance screen.

When after the operation guidance screen (see FIG. 8) has been displayed in step S24, the levers 7P and 7S are operated to the neutral positions by the marine vessel operator (step S25 of FIG. 7A: YES), the main ECU 10 ends the "forced deceleration process" that is currently being performed and restarts the normal shift position etc., computing process (step S26). The target engine speeds and the target shift positions computed in accordance with the positions of the lever 7P and 7S are thus transmitted to the respective outboard motor ECUs 30.

When the process of step S26 ends, the main ECU 10 judges whether or not the all-outboard-motor malfunction flag F is set (F=1) (step S27). If the all-outboard-motor malfunction flag F is set (F=1) (step S27: YES), that is, if there is a malfunction in the turning angle control of all outboard motors 3, the main ECU 10 stops the turning angle control of all outboard motors 3 (step S28). Specifically, the main ECU 10 transmits a turning angle control stopping command to stop the turning angle control of all outboard motors 3 to the turning ECU 20. Upon receiving the turning angle control stopping command, the turning ECU 20 stops the motor control process for the turning mechanisms 12 of all outboard motors 3. All outboard motors 3 are thus fixed at the turning angle position at that point and put in a state where turning is disabled.

Also, the main ECU 10 restricts the engine speeds of all outboard motors 3 to no more than a predetermined first restriction speed (step S29). Specifically, the main ECU 10 restricts the target engine speeds transmitted to all outboard motor ECUs 30 to no more than the predetermined first restriction speed. More specifically, in a case where a target engine speed computed based on the positions of the lever 7P and 7S is higher than the first restriction speed, the main ECU 10 restricts the target engine speed to the first restriction speed. The propulsive forces of all outboard motors 3 are thus restricted.

Figure 9:
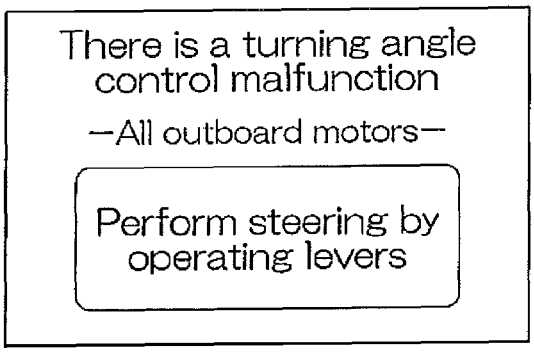
FIG. 9 is a schematic view of an example of an operation guidance screen displayed on the display in step S29 of FIG. 7A.

Thereafter, the main ECU 10 displays, on the display 9, an operation guidance screen to notify the marine vessel operator that there is a malfunction in the turning angle control of all outboard motors 3 and that steering should be performed by operating the levers 7P and 7S (step S30). An example of the operation guidance screen displayed on the display 9 in step S29 is shown in FIG. 9. The operation guidance screen includes the emergency message: "There is a turning angle control malfunction," the character string: "All outboard motors" indicating that there is a malfunction in the turning angle control of all outboard motors, and the operation guidance: "Perform steering by operating the levers."

By viewing the operation guidance screen, the marine vessel operator recognizes that there is a malfunction in the turning angle control of all outboard motors and that steering should be performed by operating the levers 7P and 7S. The marine vessel operator thus judges whether or not the turning angles of all outboard motors 3 are near the respective turning angle midpoints (step S31). If the marine vessel operator judges that the turning angles of all outboard motors 3 are not near the turning angle midpoints (step S31: NO), he/she performs the following operation. That is, the marine vessel operator opens the bypass valves 115 of the turning mechanisms 12 corresponding to all outboard motors 3, moves all outboard motors 3 to the respective turning angle midpoints manually and thereafter closes the bypass valves 115 of the turning mechanisms 12 corresponding to all outboard motors 3 (step S32). The turning angles of all outboard motors 3 are thus fixed near the turning angle midpoints. Thereafter, the marine vessel operator operates the levers 7P and 7S to steer the marine vessel 1 (step S33).

If the marine vessel operator judges that the turning angles of all outboard motors 3 are near the turning angle midpoints (step S31: YES), the marine vessel operator steers the marine vessel 1 by lever operations without performing the operation of step S32 (step S33).

In step S33, a turning operation of the marine vessel 1 by generation of a propulsive force at no less than one of the outboard motors 3 is performed in the state where the turning angles of all outboard motors 3 are fixed near the turning angle midpoints. That is, the turning operation of the marine vessel 1 is performed by output differences among the outboard motors 3. For example, the turning operation of the marine vessel 1 is performed by the lever operations described in FIG. 5A, FIG. 5B, FIG. 5E, and FIG. 5F. A turning performance of the marine vessel 1 can thus be secured even when there is a malfunction in the turning angle control of all outboard motors 3.

If in the case where there is a malfunction in the turning angle control of all outboard motors 3, the propulsive forces of the outboard motors 3 become too great due to turning the marine vessel 1 by making use of the propulsive forces of the outboard motors 3 without performing turning angle control of the outboard motors 3, it may be difficult to obtain a turning behavior intended by the marine vessel operator. Thus, in the present preferred embodiment, the engine speeds of all outboard motors 3 are restricted to no more than the predetermined first restriction speed in step S29. The propulsive forces of the outboard motors 3 can thus be prevented from becoming too large and the turning behavior intended by the marine vessel operator can be obtained readily.

In step S30, an operation guidance for making all outboard motors 3 move to the turning angle midpoints may be displayed in the operation guidance screen. In the case where a malfunction of all outboard motors 3 is detected, all outboard motors 3 may be forcibly controlled respectively to move to the turning angle midpoints automatically.

If in step S27, it is judged that the all-outboard-motor malfunction flag F is reset (F=0) (step S27: NO), that is, if there is a malfunction in the turning angle control of one of the outboard motors 3, the main ECU 10 enters step S34. In step S34, the main ECU 10 stops the turning angle control of the outboard motor 3 with the turning angle control malfunction (hereinafter referred to as the "malfunctioning outboard motor"). Specifically, the main ECU 10 transmits a turning angle control stopping command to stop the turning angle control of the malfunctioning outboard motor 3 to the turning ECU 20. Upon receiving the turning angle control stopping command, the turning ECU 20 stops the motor control process for the turning mechanism 12 of the malfunctioning outboard motor 3. The malfunctioning outboard motor 3 is thus put in a state where the turning angle control is not performed.

Figure 10:
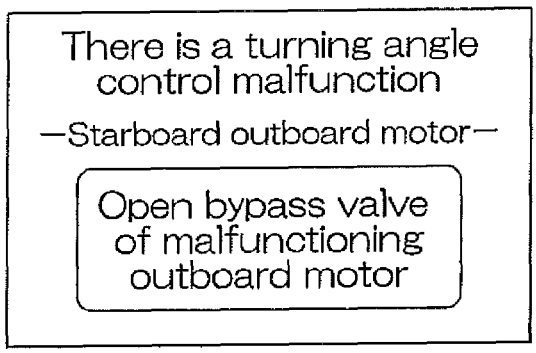
FIG. 10 is a schematic view of an example of an operation guidance screen displayed on the display in step S35 of FIG. 7C.

Thereafter, the main ECU 10 displays, on the display 9, an operation guidance screen to urge the marine vessel operator to open the bypass valve of the turning mechanism 12 corresponding to the outboard motor 3 with the turning angle control malfunction (step S35). An example of the operation guidance screen displayed on the display 9 in step S35 is shown in FIG. 10. The operation guidance screen includes the emergency message: "There is a turning angle control malfunction," the character string: "Starboard outboard motor" indicating that there is a malfunction in the turning angle control of the starboard outboard motor, and the operation guidance: "Open the bypass valve of the malfunctioning outboard motor."

Thereafter, the main ECU 10 performs a process to forcibly stop the generation of a propulsive force by the malfunctioning outboard motor 3 (hereinafter referred to at times as the "malfunctioning outboard motor propulsive force stopping process") (step S36). Specifically, the main ECU 10 fixes the target engine speed for the malfunctioning outboard motor 3 at a predetermined idle engine speed regardless of the positions of the levers 7P and 7S and fixes the target shift position for the malfunctioning outboard motor 3 at the neutral position regardless of the positions of the levers 7P and 7S.

Accordingly, at the outboard motor ECU 30 corresponding to the malfunctioning outboard motor 3, a control of setting the engine speed of the malfunctioning outboard motor 3 at the idle engine speed and a control of setting the shift position of the malfunctioning outboard motor 3 at the neutral position are performed. The power transmission between the engine 69 and the propeller 90 is thus interrupted at the malfunctioning outboard motor 3 so that the generation of a propulsive force by the malfunctioning outboard motor 3 is stopped regardless of the positions of the levers 7P and 7S. The engine speed of the malfunctioning outboard motor 3 is set at the idle engine speed to prevent wasteful fuel consumption. Thereafter, the outboard motor ECU 30 corresponding to the malfunctioning outboard motor 3 keeps the shift position of the malfunctioning outboard motor 3 at the neutral position regardless of the positions of the levers 7P and 7S. The malfunctioning outboard motor 3 is thus kept in the state where the power transmission between the engine 69 and the propeller 90 is interrupted.

With the other normally functioning outboard motors 3, such a propulsive force stopping process is not performed and thus control based on the normal shift position etc., computing process is performed. That is, the other normally functioning outboard motors 3 are kept in the state where the change of the shift position in accordance with the positions of the levers 7P and 7S is enabled and the power transmission between the engine 69 and the propeller 90 is allowed. The propulsive force can thus be secured by the other normally functioning outboard motors 3.

Thereafter, the main ECU 10 restricts the engine speeds of the other normally functioning outboard motors 3 (the outboard motors without a malfunction in the turning angle control) to no more than a predetermined second restriction speed (step S37). Specifically, the main ECU 10 restricts the target engine speeds transmitted to the other normally functioning outboard motors 3 to no more than the predetermined second restriction speed. More specifically, in a case where a target engine speed for a normally functioning outboard motor 3 computed based on the positions of the lever 7P and 7S is higher than the second restriction speed, the main ECU 10 restricts the target engine speed to the second restriction speed.

By viewing the operation guidance screen displayed in step S35 (see FIG. 10), the marine vessel operator recognizes that there is a malfunction in the turning angle control of one of the outboard motors 3 and that the bypass valve 115 of the turning mechanism 12 corresponding to the malfunctioning outboard motor 3 should be opened. The marine vessel operator thus opens the bypass valve 115 of the turning mechanism 12 corresponding to the malfunctioning outboard motor 3 (step S38). The malfunctioning outboard motor 3 is thus put in a freely turning state of pivoting freely in the right and left directions even though the turning angle control thereof cannot be performed. The malfunctioning outboard motor 3 is thus put in a state of being pivotable under the influence of an external force due to the other adjacent outboard motors 3 or by a water stream. Here, the turning angle control of the malfunctioning outboard motor 3 is kept in the stopped state by step S34. However, even if the turning angle control of the malfunctioning outboard motor 3 is continued, the hydraulic cylinder 103 is not actuated by the driving of the electric motor 102 of the corresponding turning mechanism 12 because the bypass valve 115 of the turning mechanism 12 corresponding to the malfunctioning outboard motor 3 is open.

The marine vessel operator then steers the marine vessel 1 by operating the steering handle 6 while the bypass valve 115 is kept in the open state (step S39). The turning mechanisms 12 corresponding to the normally functioning outboard motors 3 are kept in states of being capable of turning the corresponding outboard motors 3 (normal states) and thus the turning angle control of the normally functioning outboard motors 3 is performed as is done normally. The turning performance of the marine vessel 1 can thus be secured by the turning angle control of the normally functioning outboard motors 3.

As mentioned above, in the case where there is a malfunction in the turning angle control of one of the outboard motors 3, the malfunctioning outboard motor 3 is put in the state where the generation of a propulsive force is stopped and is put in the freely turning state. Thus, when the marine vessel 1 is made to travel by the propulsive force of the normally functioning outboard motors 3, the malfunctioning outboard motor 3 is turned in the same direction as the other normally functioning outboard motors 3 so as to follow a water stream generated in a periphery thereof. A possibility of a normally functioning outboard motor 3 contacting the malfunctioning outboard motor 3 when the turning angle control of the normally functioning outboard motors 3 is performed is thus low. Also, even if a normally functioning outboard motor 3 contacts the malfunctioning outboard motor 3, a load due to the contact is small.

Also, in this case, the propulsive force due to the malfunctioning outboard motor 3 is stopped and thus the marine vessel 1 travels at a lower vessel speed than a vessel speed due to a maximum propulsive force that can be generated from all outboard motors 3. The load in the case where a normally functioning outboard motor 3 contacts the malfunctioning outboard motor 3 is thus significantly reduced. Especially, with the present preferred embodiment, the engine speeds of the normally functioning outboard motors 3 are restricted to no more than the second restriction speed in step S37 and thus the load in the case where a normally functioning outboard motor 3 contacts the malfunctioning outboard motor 3 can be reduced even further.

Although preferred embodiments of the present invention have been described above, the present invention can be carried out in yet other modes as well. For example, with the preferred embodiments described above, the operation guidance screen that provides notification that the levers 7P and 7S should be operated to the neutral positions (see FIG. 8) is displayed in step S24 of FIG. 7A. Apart from this, the operation guidance screen corresponding to the case where there is a malfunction in the turning angle control of all outboard motors 3 (see FIG. 9) is displayed in step S30 of FIG. 7B and the operation guidance screen corresponding to the case where there is a malfunction in the turning angle control of one of the outboard motors 3 (see FIG. 10) is displayed in step S35 of FIG. 7C. However, the contents of the operation guidance screen of FIG. 9 or the contents of the operation guidance screen of FIG. 10 may be included, in accordance with the judgment result of step S22 of FIG. 7A, in the operation guidance screen of FIG. 8 displayed in step S24 of FIG. 7A.

Although in the preferred embodiments described above, the engine speeds of all outboard motors 3 preferably are restricted to no more than the predetermined first restriction speed in step S29 of FIG. 7B, this process may be omitted.

In the preferred embodiments described above, the target engine speed for the malfunctioning outboard motor 3 is fixed at the predetermined idling engine speed and the target shift position for the malfunctioning outboard motor 3 is fixed at the neutral position in step S36 of FIG. 7B. However, in step S36, just the target shift position for the malfunctioning outboard motor 3 may be fixed at the neutral position without fixing the target engine speed for the malfunctioning outboard motor 3 at the predetermined idling engine speed.

Although in the preferred embodiments described above, the engine speeds of the other normally functioning outboard motors 3 are preferably restricted to no more than the predetermined second restriction speed in step S37 of FIG. 7B, this process may be omitted.

Although in the preferred embodiments described above, the bypass valve 115 preferably is a manually opened/closed bypass valve, it may instead be an automatically opened/closed bypass valve that is opened and closed by electric power.

Also, although in the preferred embodiments described above, the turning mechanisms 12 of the three outboard motors 3 are preferably controlled by a single turning ECU 20 in common thereto, the turning mechanisms 12 may instead be controlled by a plurality of turning ECUs provided in respective correspondence to the plurality of outboard motors 3.

Also, although with the preferred embodiments described above, a case where the motor of each outboard motor preferably is an engine was described, the motor of each outboard motor may instead be an electric motor.

Also, although in the preferred embodiments described above, the turning mechanism 12 preferably is arranged to control the turning direction of the outboard motor by the rotation direction of the hydraulic pump 101, an arrangement is also possible where a directional control valve, driven by an electric motor, is provided between the hydraulic pump 101 and the hydraulic cylinder 103. With an arrangement provided with such a directional control valve, the hydraulic pump 101 is always rotatingly driven in a fixed direction and the turning direction of the outboard motor is controlled by control of the electric motor to drive the directional control valve.

Besides the above, various design changes may be applied within the scope of the matters described in the claims.

A non-limiting example of the correspondence between the components described in the claims and the components of the preferred embodiment described above is shown below:

motor: engine 69 steering member: steering handle 6 malfunction judging unit: main ECU 10, turning ECU 20, step S21 of FIG. 7A notifying unit: display 9, main ECU 10, step S35 of FIG. 7C power control unit: main ECU 10, outboard motor ECU 30, step S36 of FIG. 7C restricting unit: main ECU 10, outboard motor ECU 30, step S36 of FIG. 7C turning angle control stopping unit: main ECU 10, turning ECU 20, step S28 of FIG. 7B The present application corresponds to Japanese Patent Application No. 2012-228656 filed on Oct. 16, 2012 in the Japan Patent Office, and the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A method of operating a marine vessel propulsion system including a plurality of outboard motors, each of the plurality of outboard motors including a motor and a propeller rotated by the motor, and a steering apparatus arranged to control turning angles of the plurality of the outboard motors and the steering apparatus including a steering member and a plurality of turning mechanisms arranged to turn each of the plurality of outboard motors individually in accordance with an operation of the steering member and each of the turning mechanisms including a hydraulic cylinder including two cylinder chambers partitioned by a piston and a normally-closed bypass valve arranged to put the two cylinder chambers of the hydraulic cylinder in communication with each other, the method of operating the marine vessel propulsion system comprising:

a step of judging whether or not there is a malfunction in a turning angle control of at least one of the outboard motors;

a step of putting the bypass valve of a malfunctioning turning mechanism in an open state when it is judged that there is the malfunction in the turning angle control of the at least one of the outboard motors; and a step of controlling power transmission between the motor and the propeller of the at least one of the outboard motors judged to have the malfunction in the turning angle control in a neutral state, and controlling power transmission between the motor and the propeller of the outboard motor or motors, other than the at least one of the outboard motors judged to have the malfunction in the turning angle control, in a power transmittable state while maintaining the open state of the bypass valve.

2. The method of operating a marine vessel propulsion system according to claim 1, further comprising:

a step of urging a marine vessel operator to open the bypass valve of the turning mechanism corresponding to the at least one of the outboard motors judged to have the malfunction in the turning angle control when it is judged that there is the malfunction in the turning angle control of the at least one of the outboard motors.

3. The method of operating a marine vessel propulsion system according to claim 1, further comprising:

a step of judging whether there is the malfunction in the turning angle control of all of the outboard motors or there is the malfunction in the turning angle control of the at least one of the outboard motors; and a step of urging a marine vessel operator to open the bypass valve of the turning mechanism corresponding to the outboard motor judged to have the malfunction in the turning angle control when it is judged that there is the malfunction in the turning angle control of the at least one of the outboard motors.

4. The method of operating a marine vessel propulsion system according to claim 3, further comprising:

a step of notifying the marine vessel operator that there is the malfunction in the turning angle control of all of the outboard motors when it is judged that there is the malfunction in the turning angle control of all of the outboard motors.

5. The method of operating a marine vessel propulsion system according to claim 3, further comprising:

a step of moving all of the outboard motors to respective turning angle midpoints and at least one of the plurality of outboard motors is made to generate a propulsive force in a state when all of the outboard motors are fixed at the respective turning angle midpoints when it is judged that there is the malfunction in the turning angle control of all of the outboard motors.

6. The method of operating a marine vessel propulsion system according to claim 5, further comprising:

a step of opening the bypass valves of all of the turning mechanisms and moving all of the outboard motors to the respective turning angle midpoints and then closing the bypass valves of all of the turning mechanisms when it is judged that there is the malfunction in the turning angle control of all of the outboard motors.

7. The method of operating a marine vessel propulsion system according to claim 3, further comprising:

a step of controlling rotational speeds of the motors to be restricted to no more than a predetermined value in all of the outboard motors when it is judged that there is the malfunction in the turning angle control of all of the outboard motors.

8. The method of operating a marine vessel propulsion system according to claim 1, wherein the power control step includes a step of restricting the rotational speed of the motor in the other outboard motor or outboard motors to no more than a predetermined value.

9. The method of operating a marine vessel propulsion system according to claim 1, further comprising:

a step of controlling the marine vessel to run at a vessel speed lower than a maximum vessel speed corresponding to a maximum propulsive force generated by all of the outboard motors when it is judged that there is the malfunction in the turning angle control of the at least one of the outboard motors.

10. A marine vessel propulsion system comprising:

a plurality of outboard motors, each of the plurality of outboard motors including a motor and a propeller rotated by the motor; and a steering apparatus arranged to control turning angles of the plurality of the outboard motors, the steering apparatus including a steering member and a plurality of turning mechanisms arranged to turn each of the plurality of outboard motors individually in accordance with an operation of the steering member, and each of the turning mechanisms including a hydraulic cylinder including two cylinder chambers partitioned by a piston and a normally-closed bypass valve arranged to put the two cylinder chambers of the hydraulic cylinder in communication with each other;

a malfunction judging unit arranged to judge whether or not there is a malfunction in the turning angle control of at least one of the outboard motors;

a notifying unit that, when the malfunction judging unit judges that there is the malfunction in the turning angle control of the at least one of the outboard motors, urges the marine vessel operator to open the bypass valve of the turning mechanism corresponding to the at least one of the outboard motors judged to have the malfunction in the turning angle control; and a power control unit arranged to control power transmission between the motor and the propeller of the at least one of the outboard motors judged to have the malfunction in the turning angle control in a neutral state, and to control power transmission between the motor and the propeller in the outboard motor or outboard motors, other than the at least one of the outboard motors judged to have the malfunction in the turning angle control, in a power transmittable state.

11. The marine vessel propulsion system according to claim 10, further comprising:

a restricting unit that, when the malfunction judging unit judges that there is the malfunction in the turning angle control of the at least one of the outboard motors, restricts a rotational speed of the motor to no more than a predetermined value in the at least one of the outboard motors judged to have the malfunction in the turning angle control.

12. The marine vessel propulsion system according to claim 10, wherein each of the bypass valves is a manually opened/closed bypass valve.

13. The marine vessel propulsion system according to claim 10, wherein each of the bypass valves is an automatically opened/closed bypass valve.

14. The marine vessel propulsion system according to claim 10, further comprising:

a turning angle control stopping unit that, when the malfunction judging unit judges that there is the malfunction in the turning angle control of all of the outboard motors, stops the turning angle control of all of the outboard motors.

15. The marine vessel propulsion system according to claim 10, wherein the malfunction judging unit is arranged to judge that there is the malfunction in the turning angle control of all of the outboard motors when a malfunction due to an input system in common to all of the turning mechanisms is detected and to judge that there is the malfunction in the turning angle control of the at least one of the outboard motors when a malfunction due to output systems of the respective turning mechanisms is detected.

16. The marine vessel propulsion system according to claim 15, wherein the malfunction due to the input system includes a malfunction of an operation amount detection sensor arranged to detect an operation amount of the steering member, and the malfunction due to the output systems includes a malfunction of turning angle sensors arranged to detect the turning angles of the outboard motors and a malfunction of the respective turning mechanisms.

17. A marine vessel comprising:

a hull; and a marine vessel propulsion system according to claim 10 attached to the hull.

* * * * *